US007461533B2

(12) United States Patent
Otaki et al.

(10) Patent No.: US 7,461,533 B2
(45) Date of Patent: Dec. 9, 2008

(54) FORGING METHOD FORGED PRODUCT AND FORGING APPARATUS

(75) Inventors: Atsushi Otaki, Oyama (JP); Hidemitsu Hamano, Oyama (JP)

(73) Assignee: Showa Denko K.K., Tokyo (JP)

( * ) Notice: Subject to any disclaimer, the term of this patent is extended or adjusted under 35 U.S.C. 154(b) by 96 days.

(21) Appl. No.: 10/566,467

(22) PCT Filed: Jul. 30, 2004

(86) PCT No.: PCT/JP2004/011331

§ 371 (c)(1),
(2), (4) Date: Aug. 4, 2006

(87) PCT Pub. No.: WO2005/011893

PCT Pub. Date: Feb. 10, 2005

(65) Prior Publication Data

US 2007/0181635 A1 Aug. 9, 2007

Related U.S. Application Data

(60) Provisional application No. 60/492,735, filed on Aug. 6, 2003.

(30) Foreign Application Priority Data

Jul. 31, 2003 (JP) ..... 2003-284440
Jul. 26, 2004 (JP) ..... 2004-216903

(51) Int. Cl.
*B21D 22/00* (2006.01)
*B21D 37/16* (2006.01)

(52) U.S. Cl. ..... 72/359; 72/352; 72/353.2; 72/377

(58) Field of Classification Search ..... 72/342.1, 72/342.94, 342.96, 364, 352, 353.2, 354.6, 72/354.8, 355.2, 355.4, 355.6, 356, 358, 72/359, 256, 266, 267, 361, 377, 394, 441, 72/443

See application file for complete search history.

(56) References Cited

U.S. PATENT DOCUMENTS 2,495,060 A * 1/1950 Hanna ..... 219/151
(Continued)

FOREIGN PATENT DOCUMENTS

JP 48-62646 12/1971
(Continued)

OTHER PUBLICATIONS

U.S. Appl. No. 10/566,467, filed Jan. 31, 2006, Otaki et al.

*Primary Examiner*—Edward Tolan
(74) *Attorney, Agent, or Firm*—Oblon, Spivak, McClelland, Maier & Neustadt, P.C.

(57) ABSTRACT

A forging apparatus 1A includes a swaging apparatus 2 equipped with a fixing die 10, a guide 20 having an insertion passage 22 for inserting and holding a bar-shaped raw material 5 in a buckling preventing state, and a punch 30. The raw material 5 is fixed to the fixing die 10 with the one end portion of the raw material protruded. The one end portion of the raw material 5 is inserted into the insertion passage 22 of the guide 20. Thereafter, while pressing the raw material 5 with the punch 30 in the axial direction, in a state in which an entire peripheral surface of the exposed portion 8 of the raw material 5 exposed between the guide 20 and the fixing die 10 is not restrained, the guide 20 is moved in a direction opposite to the moving direction of the punch 30 so that a length of the exposed portion 8 of the raw material 5 becomes a budding limit length or less at a cross-sectional area of the exposed portion 8 of the raw material 5. Thus, the one end portion of the raw material 5 is subject to swaging processing.

14 Claims, 17 Drawing Sheets

U.S. PATENT DOCUMENTS

| | | | | | |
|---|---|---|---|---|---|
| 2,572,492 | A | * | 10/1951 | Kempf | 72/341 |
| 2,647,979 | A | * | 8/1953 | Knight et al. | 219/151 |
| 3,198,928 | A | * | 8/1965 | Allison | 219/602 |
| 5,475,999 | A | * | 12/1995 | Sekiguchi et al. | 72/259 |
| 2006/0260380 | A1 | | 11/2006 | Otaki | |

FOREIGN PATENT DOCUMENTS

| | | | |
|---|---|---|---|
| JP | 59-130641 | | 7/1984 |
| JP | 61-60236 | | 3/1986 |
| JP | 62-34642 | | 2/1987 |
| JP | 63-30142 | * | 2/1988 |
| JP | 9-253782 | | 9/1997 |
| JP | 2003-290862 | | 10/2003 |
| WO | 93-/17808 | | 9/1993 |

* cited by examiner

FORGING METHOD FORGED PRODUCT AND FORGING APPARATUS

CROSS REFERENCE TO RELATED APPLICATIONS

Priority is claimed to Japanese Patent Application No. 2003-284440 filed on Jul. 31, 2003, U.S. Provisional Application No. 60/492,735 filed on Aug. 6, 2003 and Japanese Patent Application No. 2004-216903 filed on Jul. 26, 2004, the disclosure of which are incorporated by reference in their entireties.

This application is an application filed under 35 U.S.C. § 111(a) claiming the benefit pursuant to 35 U.S.C. § 119(e)(1) of the filing date of U.S. Provisional Application No. 60/492,735 filed on Aug. 6, 2003 pursuant to 35 U.S.C. § 111(b).

TECHNICAL FIELD

The present invention relates to a forging method, a forged product and a forging apparatus. More specifically, it relates to, for example, a forging method for forming an enlarged diameter portion at a prescribed portion of a bar-shaped raw material by subjecting the prescribed portion of the raw material to swaging processing, a forged product obtained by the forging method and a forging apparatus for performing the forging method.

BACKGROUND ART

Generally, swaging is processing for forming an enlarged diameter portion at a prescribed portion of a raw material by pressing the raw material in the axial direction thereof. In the swaging processing, if the raw material is budded during the swaging processing, the obtained product becomes poor in shape (wrinkled or laps), deteriorating the value as a product. In order to prevent the occurrence of such buckling, conventionally, the following swaging method is known (see Japanese Unexamined Laid-open Patent Publication No. S48-62646, pages 1-2, FIGS. 1-4).

In this method, a pressing die is fitted in a forming dented portion of a female die, and a raw material is inserted in the forming dented portion via a penetrated hole formed in the pressing die. Then, a male die is inserted in the penetrated hole to forcibly press the raw material toward the forming dented portion to thereby fill the forming dented portion with the raw material while moving the pressing die backward to obtain a product having a prescribed shape.

According to the aforementioned conventional processing method, the peripheral surface of the raw material pressed in the forming dented portion of the female die is restrained by the female die during the processing. Accordingly, the conventional processing method can be classified into a restrain swaging method. The restrain swaging method, however, has such a drawback that higher forming pressure is generally required. Thus, in the conventional processing method, it is required to prepare a forging apparatus capable of generating higher forming pressure, causing higher cost to employ such a forging apparatus. Furthermore, since larger load will be applied to the forming dented portion of the female die at the time of the swaging processing, resulting in a shortened life of the female die.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

DISCLOSURE OF INVENTION

The preferred embodiments of the present invention have been developed in view of the above-mentioned and/or other problems in the related art. The preferred embodiments of the present invention can significantly improve upon existing methods and/or apparatuses.

Among other potential advantages, some embodiments can provide a forging method capable of performing swaging processing under lower forming pressure and preventing the occurrence of buckling of a raw material which may sometimes be generated during the swaging processing.

Among other potential advantages, some embodiments can provide a forged product obtained by the forging method and a forging apparatus preferably employed to perform the forging method.

The present invention provides the following means.

[1] A forging method using a swaging apparatus equipped with a fixing die for fixing a bar-shaped raw material, a guide having an insertion passage for inserting and holding the raw material in a buckling preventing state, and a punch for pressing the raw material inserted in and held by the insertion passage of the guide in an axial direction of the raw material, wherein a scheduled enlarged diameter portion of the raw material fixed to the fixing die with the scheduled enlarged diameter portion protruded is inserted into the insertion passage of the guide, and thereafter, while pressing the raw material with the punch by moving the punch, in a state in which a part of a peripheral surface of an exposed portion of the raw material exposed between the guide and the fixing die is restrained or an entire peripheral surface of the exposed portion of the raw material is not restrained, the scheduled enlarged diameter portion of the raw material is subjected to swaging processing by moving the guide in a direction opposite to a moving direction of the punch so that a length of the exposed portion of the raw material becomes a buckling limit length or less at a cross sectional area of the exposed portion of the raw material.

[2] The forging method as recited in Item [1], wherein an initial clearance having a distance is formed between the guide and the fixing die prior to an initiation of a movement of the punch, the distance being set to be the buckling limit length or less at the cross-sectional area of the exposed portion of the raw material exposed between the guide and the fixing die.

[3] The forging method as recited in Item [2], wherein a time lag is provided between the initiation of the movement of the punch and an initiation of a movement of the guide.

[4] The forging method as recited in Item [3], wherein the time lag is set such that a total volume of a volume of the exposed portion of the raw material exposed within a range of the initial clearance at the time prior to the initiation of the movement of the punch and an increased volume of the raw material to be increased during the time lag within the range of the initial clearance does not exceed a volume of the raw material existing within the range of the initial clearance in a scheduled shape of the enlarged diameter portion of the raw material to be formed by the swaging processing.

[5] A forging method using a swaging apparatus equipped with a fixing die for fixing a bar-shaped raw material, a guide having an insertion passage for inserting and holding the raw material in a buckling preventing state, and a punch for pressing the raw material inserted in and held by the insertion passage of the guide in an axial direction of the raw material, wherein a scheduled enlarged diameter portion of the raw material fixed to the fixing die with the scheduled enlarged diameter portion protruded is inserted into the insertion passage of the guide, and thereafter, while pressing the raw material with the punch by moving the punch, in a state in which a part of a peripheral surface of an exposed portion of the raw material exposed-between the guide and the fixing die is restrained or an entire peripheral surface of the exposed portion of the raw material is not restrained, the scheduled enlarged diameter portion of the raw material is subjected to swaging processing by moving the guide in a direction opposite to a moving direction of the punch, where "P" is an average moving speed of the punch from an initiation of a movement thereof;

"G" is an average moving speed of the guide from an initiation of the movement thereof;

"$X_0$" is a buckling limit length at the cross-sectional area of the raw material before the swaging processing;

"$X_1$" is a buckling limit length at the cross-sectional area of the enlarged diameter portion of the raw material after the swaging processing;

"X" is an initial clearance between the guide and the fixing die ($0 \leqq X \leqq X_0$);

"$t_0$" is a time lag from the initiation of the movement of the punch to the initiation of the movement of the guide ($0 \leqq t_0$);

"L" is a length of the enlarged diameter portion of the raw material after the swaging processing;

"$l_0$" is a length of the raw material in the state prior to the swaging processing required for the enlarged diameter portion; and "T" is a swaging processing time from the initiation of the movement of the punch, if $t_0 < T$, "G" satisfies the following relational expression:

$$(L-X)/[(l_0-L)/P-t_0] \leqq G \leqq P(X_1-X)/(l_0-X_1-Pt_0).$$

[6] The forging method as recited in Item [5], wherein the scheduled enlarged diameter portion of the raw material is an end portion of the raw material.

[7] The forging method as recited in Item [5], wherein the scheduled enlarged diameter portion of the raw material is an axial central portion of the raw material.

[8] The forging method as recited in Item [5], wherein the scheduled enlarged diameter portion of the raw material is one end portion of the raw material and the other end portion thereof, wherein the one end portion and the other end portion of the raw material fixed to the fixing die with one end portion and the other end portion protruded are inserted into the insertion passage of corresponding guide, and wherein the one end portion and the other end portion are simultaneously subjected to swaging processing.

[9] The forging method as recited in any one of Items [1] to [8], wherein an edge portion of a leading end surface of the guide at a side of the insertion passage and/or an opening edge portion of a raw material fixing and fitting aperture formed in the fixing die are beveled.

[10] The forging method as recited in any one of Items [1] to [9], wherein the scheduled enlarged diameter portion of the raw material is subjected to swaging processing with a part of a peripheral surface of the raw material restrained by a restraining die portion having a forming dented portion, and thereafter the enlarged diameter portion of the raw material is pressed with a second punch provided at the restraining die portion to thereby fill the forming dented portion with the material of the enlarged diameter portion by plastically deforming the enlarged diameter portion within the forming dented portion of the restraining die portion.

[11] The forging method as recited in Item [10], wherein the fixing die is provided with a flash forming dented portion continuing from the forming dented portion of the restraining die portion, and wherein the material of the enlarged diameter portion is filled into the forming dented portion and the flash forming dented portion by plastically deforming the enlarged diameter portion within the forming dented portion of the restraining die portion.

[12] The forging method as recited in Item [10], wherein the forming dented portion is a closed dented portion.

[13] A forged product obtained by the forging method as recited in any one of Items [1] to [12].

[14] A forging apparatus, comprising a swaging apparatus, wherein the swaging apparatus includes:

a fixing die for fixing a bar-shaped raw material;

a guide having an insertion passage for inserting and holding the raw material in a buckling preventing state;

a punch for pressing the raw material inserted in and held by the insertion passage of the guide in an axial direction of the raw material; and a guide driving device for moving the guide in a direction opposite to a moving direction of the punch so that a length of the exposed portion of the raw material exposed between the guide and the fixing die becomes a buckling limit length or less at a cross-sectional area of the exposed portion of the raw material.

[15] The forging apparatus as recited in Item [14], wherein the swaging apparatus performs swaging processing in a state in which a part of a peripheral surface of the exposed portion of the raw material is restrained or an entire peripheral surface of the exposed portion of the raw material is not restrained.

[16] The forging apparatus as recited in Item [14] or [15], wherein the swaging apparatus further includes a restraining die portion for restraining a part of the peripheral surface of the exposed portion of the raw material.

[17] The forging apparatus as recited in Item [16], wherein the restraining die portion is provided with a second punch for pressing the enlarged diameter portion of the raw material formed by the swaging apparatus and a forming dented portion into which the material of the enlarged diameter portion is filled by the pressing of the enlarged diameter portion by the second punch.

[18] The forging apparatus as recited in Item [17], wherein the fixing die is provided with a flash forming dented portion continuing from the forming dented portion of the restraining die portion.

[19] The forging apparatus as recited in Item [17], wherein the forming dented portion is a closed dented portion.

In the invention as recited in Item [1], in a state in which a part of a peripheral surface of an exposed portion of the raw material exposed between the guide and the fixing die is restrained or an entire peripheral surface of the exposed portion of the raw material is not restrained, the scheduled enlarged diameter portion of the raw material is subjected to swaging processing. That is, the swaging method of the forging method according to the invention as recited in Item [1] can be classified into a free swaging method or a partially restrained swaging method. Therefore, in the invention as recited in Item [1], the swaging processing can be performed to the scheduled enlarged diameter portion of the raw material under lower forming pressure. In a concrete example, according to the forging method as recited in Item [1], the forming pressure could have reduced into about ¼ of the forming pressure of the aforementioned conventional forging method. Furthermore, the swaging processing can be performed to me scheduled enlarged diameter portion of the raw material not necessarily using a die, resulting in reduced manufacturing cost Furthermore, since the scheduled enlarged diameter portion of the raw material is subjected to swaging processing by moving the guide in a direction opposite to a moving direction of the punch so that a length of the exposed portion of the raw material becomes a buckling limit length or less at a cross-sectional area of the exposed portion of the raw material while pressing the raw material with the punch by moving the punch, buckling of the raw material which may sometimes be occurred during swaging processing can be prevented from being occurred.

In the invention as recited in Item [2], since an initial clearance having a certain distance is provided between the guide and the fixing die, it is possible to prevent a problem that the exposed portion of the raw material exposed within the initial clearance between the guide and the fixing die is buckled immediately after the initiation of the movement of the punch (i.e., immediately after the initiation of the swaging processing). Furthermore, the moving length (stroke) of the guide can be shortened.

In the invention as recited in Item [3], by providing a time lag between the initiation of the movement of the punch and an initiation of a movement of the guide, the cross-sectional area of the exposed portion of the raw material exposed within the initial clearance between the guide and the fixing die increases immediately after the initiation of the movement of the punch (i.e., immediately after the initiation of the swaging processing). Therefore, the buckling limit length of the exposed portion of the raw material can be increased, which makes it possible to assuredly prevent the occurring of buckling.

In the invention as recited in Item [4], since the time lag is set such that a total volume of a volume of the exposed portion of the raw material exposed within a range of the initial clearance at the time prior to the initiation of the movement of the punch and an increased volume of the raw material to be increased during the time lag within the range of the initial clearance does not exceed a volume of the raw material existing within the range of the initial clearance in a scheduled shape of the enlarged diameter portion of the raw material to be formed by the swaging processing, the scheduled enlarged diameter portion of the raw material can be assuredly enlarged in diameter into the scheduled shape.

In the invention as recited in Item [5], in the same manner as in the invention recited in Item [1], the scheduled enlarged diameter portion of the raw material is subjected to swaging processing in a state in which a part of a peripheral surface of an exposed portion of the raw material exposed between the guide and the fixing die is retrained or an entire peripheral surface of the exposed portion of the raw material is not restrained. Therefore, in the invention as recited in Item [5], the scheduled enlarged diameter portion of the raw material can be subjected to the swaging processing under lower forming pressure. Furthermore, the swaging processing can be performed to the scheduled enlarged diameter portion of the raw material not necessarily using a die, resulting in reduced manufacturing cost.

Furthermore, since the average moving speed G of the guide from the initiation of the movement of the guide satisfies the predetermined relational expression in the case of $t_0<T$, it is possible to prevent a problem that there remains un-enlarged diameter portion in the scheduled enlarged diameter portion of the raw material at the time of completion of the movement of the punch (i.e., at the time of completion of the swaging processing), enabling the scheduled enlarged diameter portion of the raw material to be assuredly enlarged. It is also possible to assuredly prevent the occurring of buckling of the raw material which may sometimes be occurred during the swaging processing.

In the invention as recited in Item [6], since the scheduled enlarged diameter portion of the raw material is an end portion of the raw material, the end portion of the raw material can be enlarged in diameter into a scheduled shape.

In the invention as recited in Item [7], since the scheduled enlarged diameter portion of the raw material is an axial central portion of the raw material, the axial central portion of the raw material can be enlarged in diameter into a scheduled shape.

In the invention as recited in Item [8], since the one end portion of the raw material and the other end portion thereof are simultaneously subjected to swaging processing, the processing efficiency of the swaging processing can be enhance.

In the invention as recited in Item [9], since an edge portion of a leading end surface of the guide at a side of the insertion passage is beveled, the guide can effectively receive back pressure from the exposed portion of the raw material at the time of the swaging processing. As a result, in a guide driving device for moving the guide in a certain direction, the driving force required for moving the guide can be decreased. Therefore, the guide can be moved by a guide driving device having smaller driving force. Furthermore, since the opening edge portion of the raw material fixing and fitting aperture of the fixing die is beveled, it becomes possible to prevent problems such as laps which may sometimes be generated during after processing.

In the invention as recited in Item [10], by subjecting the scheduled enlarged diameter portion of the raw material to swaging processing with a part of a peripheral surface of the raw material restrained by the restraining die portion having a forming dented portion, a preform for a forged product of a scheduled design shape can be obtained. Thereafter, by pressing the enlarged diameter portion of the raw material with a second punch provided at the restraining die portion to thereby fill the forming dented portion with the material of the enlarged diameter portion by plastically deforming the enlarged diameter portion within the forming dented portion of the restraining die portion, a forged product of a scheduled design shape or a forged product of a shape near the scheduled design shape (a forged product with flash) can be obtained.

Thus, in the invention as recited in Item [10], a forged product of a scheduled design shape or a forged product of a shape near the scheduled design shape can be obtained without detaching the raw material from the fixing die or newly attaching a die after the swaging operation of the scheduled enlarged diameter portion of the raw material. Accordingly, the number of dies or steps can be decreased, resulting in reduced manufacturing cost.

In the invention as red in Item [11], since the material of the enlarged diameter portion is filled into the forming dented portion and the flash forming dented portion, the forming of the enlarged diameter portion of the raw material can be performed under lower forming pressure, which in turn can extend the life of the forming dented portion. Furthermore, in this case, a preform which is a forged product of a shape near the scheduled design shape can be obtained, and therefore extremely increased yielding can be attained.

In the invention as recited in Item [12], since the forming dented portion is a closed dented portion, a forged product of a scheduled design shape can be obtained by plastically deforming the enlarged diameter portion of the raw material within the forming dented portion to thereby fill the forming dented portion with the material of the enlarged diameter portion. Accordingly, in the invention as recited in Item [12], it is not required to remove flashes, resulting in reduced processing steps and enhanced product yielding.

In the invention as recited in Item [13], it is possible to provide a high quality forged product at low cost.

In the invention as recited in Item [14], since the forging apparatus includes a swaging apparatus equipped with a fixing die, a guide, a punch and a guide driving device, the apparatus can be preferably used to perform the aforementioned forging method.

In the invention as recited in Item [15], the swaging apparatus of the forging apparatus performs the swaging processing in a so in which a part of a peripheral surface of the exposed portion of the raw material is restrained or an entire peripheral surface of the exposed portion of the raw material is not restrained, by using the forging apparatus including the swaging apparatus, the aforementioned forging method of the present invention can be executed assuredly.

In the invention as recited in Item [16], since the swaging apparatus is further equipped with a certain restraining die portion, by using the forging apparatus including the swaging apparatus, the aforementioned forging method of the present invention can be performed more assuredly.

In the invention as recited in Item [17], since the lining die portion of the swaging apparatus is provided with a certain second punch and a certain forming dented portion, by using the forging apparatus including the swaging apparatus, the aforementioned forging method of the present invention as recited in Item [10] can be performed assuredly.

In the invention as recited in Item [18], since the fixing die is provided with a flash forming dented portion continuing from the forming dented portion of the restraining die portion, by using the forging apparatus including the swaging apparatus, the aforementioned forging method of the present invention as recited in Item [11] can be performed assuredly.

In the invention as recited in Item [19], since the forming dented portion is a closed dented portion, by using the forging apparatus including the swaging apparatus, the aforementioned forging method of the present invention as recited in Item [12] can be performed assuredly.

The effects of the present invention can be summarized as follows.

According to the invention as recited in Item [1], swaging processing can be subjected to the scheduled enlarged diameter portion of the raw material under lower forming pressure. Furthermore, the swaging processing can be executed to the scheduled extended diameter portion of the raw material not necessarily using a die, resulting in reduced manufacturing cost. Furthermore, it is possible to prevent the buckling of the raw material which may sometimes occur during the swaging processing. Thus, according to the invention as recited in Item [1], a high quality forged product can be obtained at low cost.

According to the invention as recited in Item [2], it is possible to prevent a problem that the exposed portion of the raw material is budded immediately after the initiation of the movement of the punch (i.e., immediately after the initiation of the swaging processing). Furthermore, it is possible to reduce the moving length (stroke) of the guide.

According to the invention as recited in Item [3], it is possible to increase the buckling limit length of the exposed portion of the raw material immediately after the initiation of the movement of the punch, and therefore the occurrence of buckling can be prevented assuredly.

According to the invention as recited in Item [4], it is possible to assuredly enlarge the scheduled enlarged diameter portion of the raw material into a scheduled shape.

According to the invention as recited in Item [5], it is possible to perform the swaging processing of the scheduled enlarged diameter portion of the raw material under lower forming pressure. Furthermore, the scheduled enlarged diameter portion of the raw material can be assuredly enlarged into a scheduled shape, and further it is possible to assuredly prevent the occurrence of buckling of the raw material which may sometimes occur during the swaging processing.

According to the invention as recited in Item [6], t is possible to enlarge the end portion of the raw material into a scheduled shape.

According to the invention as recited in Item [7], it is possible to enlarge the axial central portion of the raw material into a scheduled shape.

According to the invention as recited in Item [8], it is possible to improve the operating efficiency of the swaging processing.

According to the invention as recited in Item [9], since the edge portion of the leading end surface of the guide at the side of the insertion passage is beveled, the guide can effectively receive back pressure from the exposed portion of the raw material at the time of the swaging processing. As a result, in a guide driving device for moving the guide in a certain direction, the driving force required for moving the guide can be decreased. Therefore, the guide can be moved by a guide driving device having smaller driving force. Furthermore, since the opening edge portion of the raw material fixing and fitting aperture of the fixing die is beveled, it becomes possible to prevent problems such as laps which may sometimes be generated during after processing.

According to the invention as mated in Item [10], a forged product of a scheduled design shape or a forged product of a shape near the scheduled design shape can be obtained without detaching the raw material from the fixing die or newly attaching a die after the swaging operation of the scheduled enlarged diameter portion of the raw material. Accordingly, the number of dies or steps can be decreased, resulting in reduced manufacturing cost.

According to the invention as recited in Item [11], the forming of the enlarged diameter portion of the raw material can be performed under lower forming pressure, which in turn can extend the life of the forming dented portion. Furthermore, in this case, a preform which is a forged product of a shape near the scheduled design shape can be obtained, and therefore extremely increased yielding can be attained.

According to the invention as recited in Item [12], it is not required to remove flashes, resulting in reduced processing steps and enhanced product yielding.

According to the invention as recited in Item [13], it is possible to provide a high quality forged product at low cost.

According to the invention as recited in Item [14], the apparatus can be preferably used to perform the aforementioned forging method.

According to the invention as recited in Item [15], it is possible to provide a forging method capable of assuredly performing the aforementioned forging method of the invention.

According to the invention as recited in Item [16], it is possible to provide a forging method capable of more assuredly performing the aforementioned forging method of the invention.

According to the invention as recited in Item [17], it is possible to provide a forging method capable of assuredly performing the aforementioned forging method of the invention as recited in Item [10].

According to the invention as recited in Item [18], it is possible to provide a forging method capable of assuredly performing the aforementioned forging method of the invention as recited in Item [11].

According to the invention as recited in Item [19], it is possible to provide a forging method capable of assuredly performing the aforementioned forging method of the invention as recited in Item [12].

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF DRAWINGS

The preferred embodiments of the present invention are shown by way of example, and not limitation, in the accompanying figures, in which.

BEST MODE FOR CARRYING OUT THE INVENTION

In the following paragraphs, some preferred embodiments of the invention will be described by way of example and not limitation. It should be understood based on this disclosure that various other modifications can be made by those in the art based on these illustrated embodiments.

Figure 1:
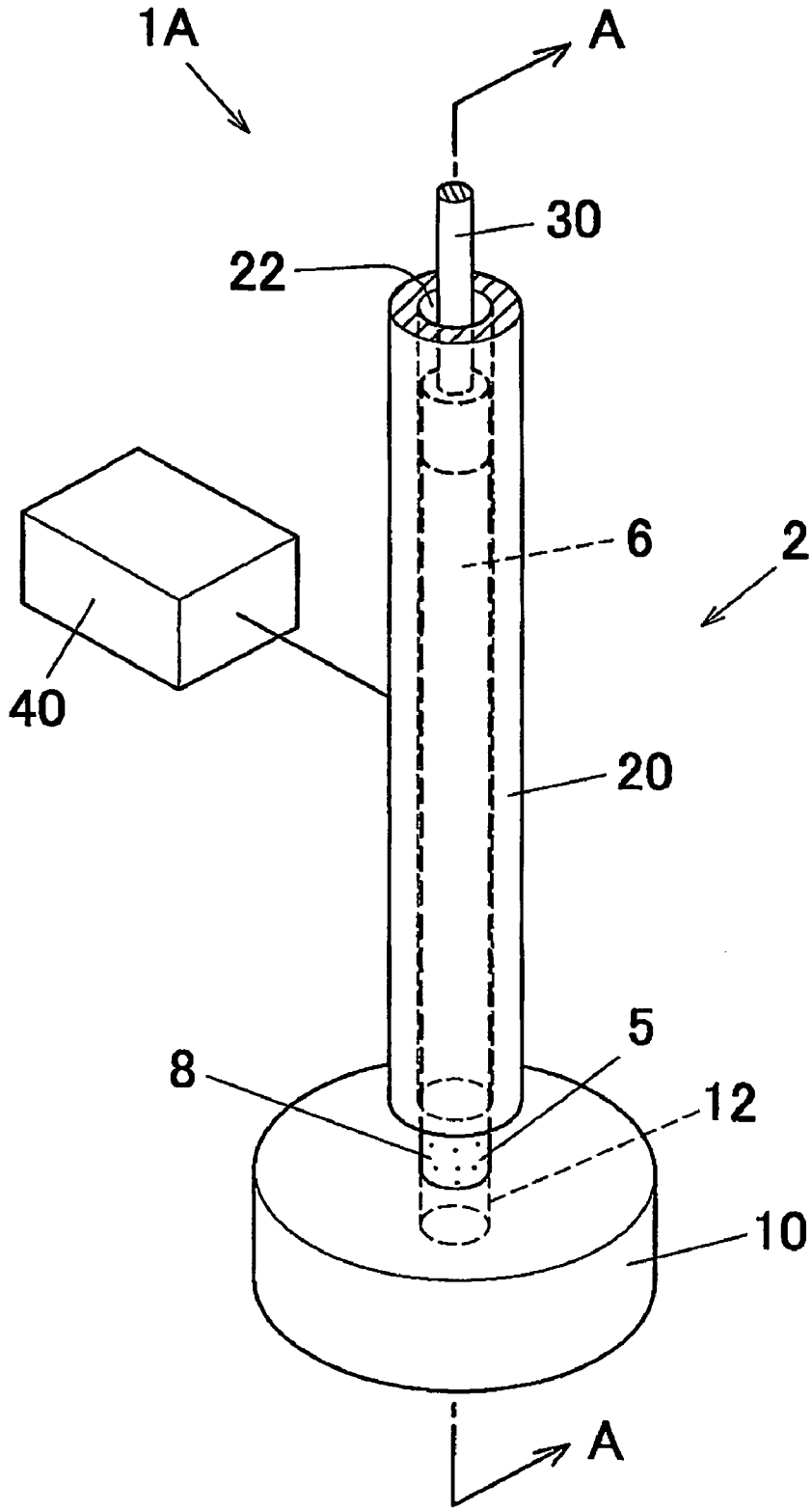
FIG. 1 is a schematic view showing the state before subjecting an end portion of a raw material to swaging by a forging apparatus according to a first embodiment of the present invention.

FIGS. 1 to 4 are schematic views illustrating a forging method using a forging apparatus according to a first embodiment of the present invention. In FIG. 1, the reference numeral "1A" denotes a forging apparatus of the first embodiment, and "5" denotes a raw material.

Figure 2:
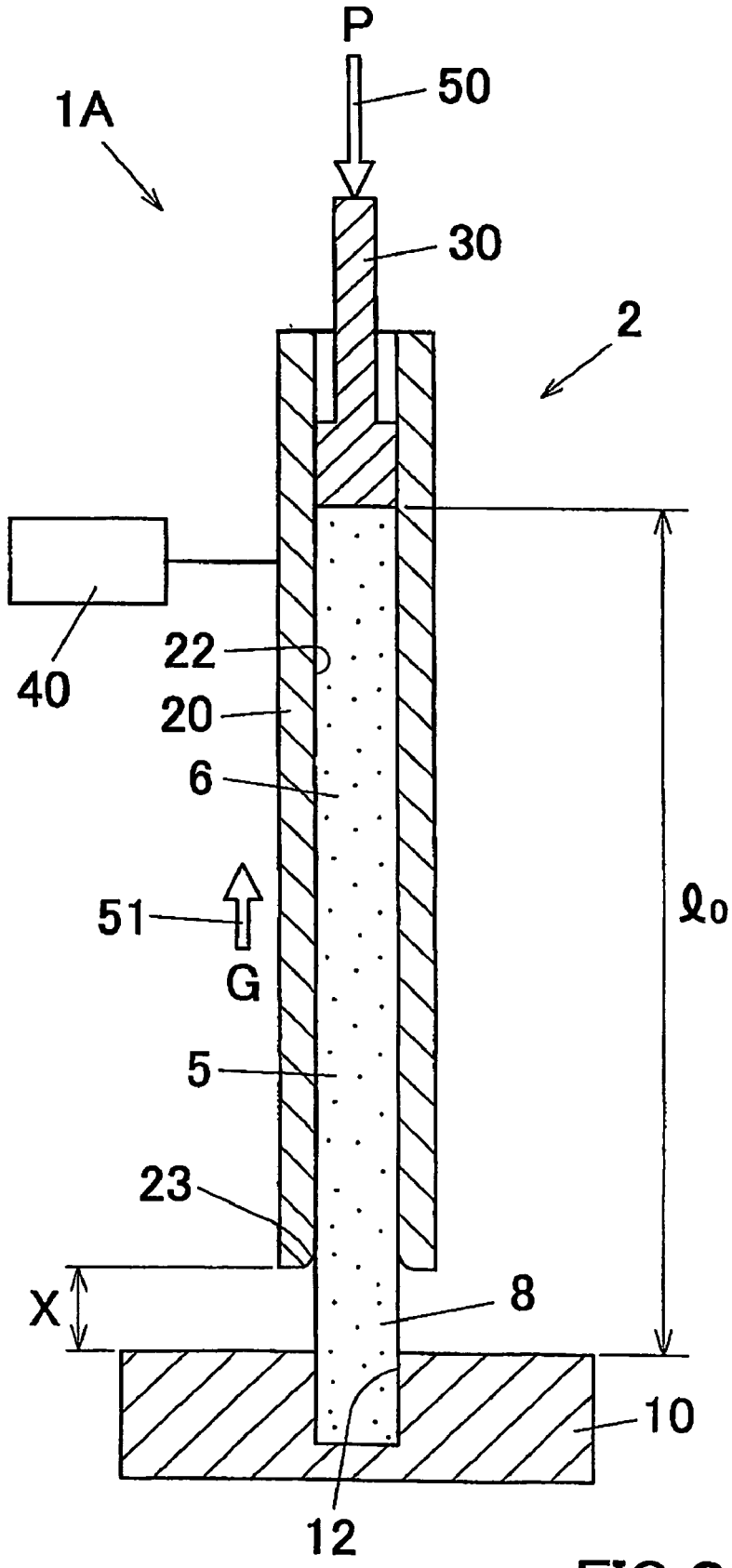
FIG. 2 is a cross-sectional view taken along the line A-A in FIG. 1.
Figure 3:
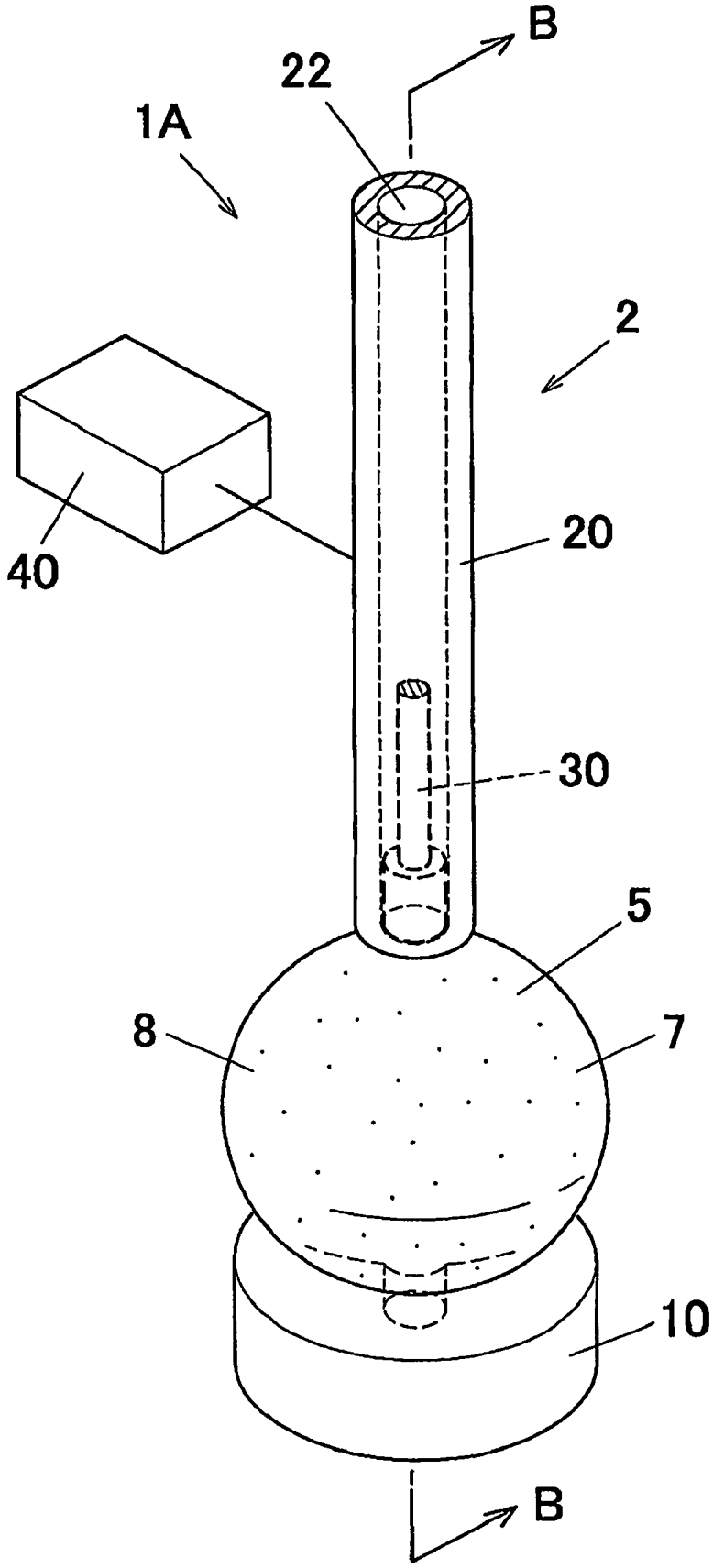
FIG. 3 is a schematic view showing the state after subjecting the end portion of the raw material to swaging processing by the forging apparatus.
Figure 4:
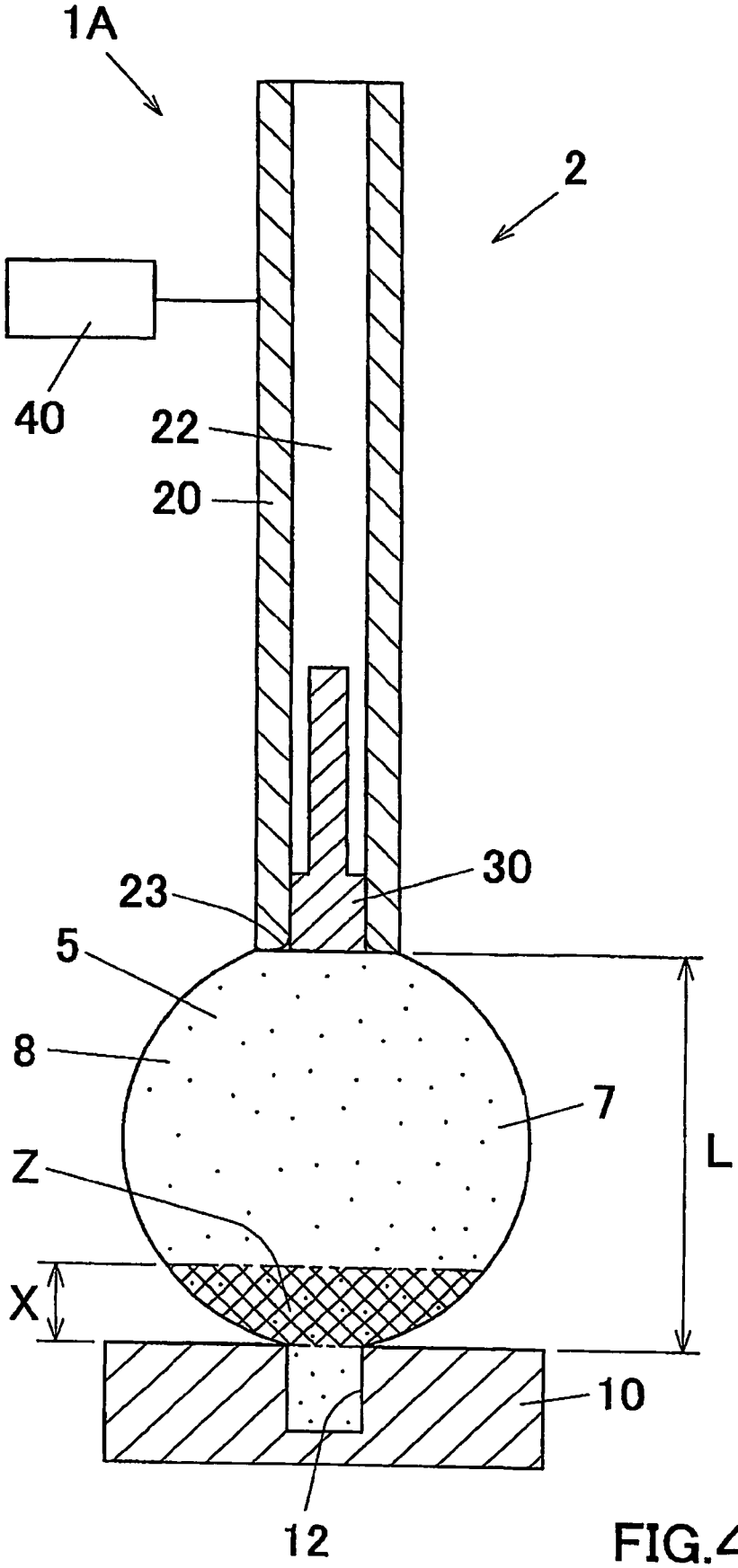
FIG. 4 is a cross sectional view taken along the line B-B in FIG. 3.

The raw material 5 is a straight bar-shaped member with a round cross-sectional shape as shown in FIGS. 1 and 2. The cross-sectional area of the raw material 5 is constant along the axial direction thereof. The raw material 5 is made of aluminum or aluminum alloy. In the first embodiment, the scheduled enlarged diameter portion 6 of the raw material 5 to be enlarged in diameter is one end portion thereof (the upper end portion in FIGS. 1 and 2). The entire periphery of the one end portion of the raw material 5 will be enlarged in diameter as shown in FIGS. 3 and 4 after the swaging processing. In detail, the one end portion of the raw material 5 will be enlarged into a spherical shape. In these figures, the reference numeral "7" denotes an enlarged diameter portion of the raw material 5 formed by the swaging processing.

In the present invention, the cross sectional shape of the raw material 5 is not limited to a round shape, and can be a polygonal shape or an elliptical shape for example. The material of the raw material 5 is not limited to aluminum or its alloy, and can be metal such as copper or plastic for example. Especially, the forging method and the forging apparatus can be preferably applied to the case in which the material of the raw material is aluminum or its alloy.

The forging apparatus 1A is provided with a swaging apparatus 2. This swaging apparatus 2 is equipped with a fixing die 10, a guide 20, a guide driving device 40 and a punch 30. This swaging apparatus 2 is a free swaging apparatus, and therefore is not equipped with a die for forming the enlarged diameter portion 7 of the raw material 5 during the swaging processing.

The fixing die 10 is used for fixing the raw material 5, i.e., for fixing the raw material 5 so as not to move in the axial direction during the swaging processing. The fixing die 10 has a raw material fixing and fitting aperture 12 in which the raw material 5 is immovably fitted. In this first embodiment, with one end of the raw material 5 protruded, the raw material 5 is fixed by fitting the other end (the lower end in FIG. 1) of the raw material 5 in the raw material fixing and fitting aperture 12.

The guide 20 has an insertion passage 22 for holding the raw material 5 in the buckling preventing state. That is, this guide 20 holds the raw material 5 inserted in the insertion passage 22 so that the raw material 5 is prevented from being buckled. The insertion passage 22 is formed through the guide 20 in a penetrated manner along the axial direction thereof. The diameter of the insertion passage 22 is set to have a size capable of inserting the raw material 5 in a fitted and slidable manner. In the first embodiment, the guide 20 is a hollow-pile-like member, and the insertion passage 22 of the guide 20 is a insertion aperture.

As shown in FIG. 2, the edge portion of the leading end surface of the guide 20 at the side of the insertion passage 20 is beveled around the entire periphery thereof, and therefore the cross-sectional shape of the edge portion is formed into a round shape. In FIG. 2, the reference numeral "23" denotes a beveled portion formed at the edge portion.

The punch 30 is used for pressing (giving pressure to) the raw material 5 held in the insertion passage 22 of the guide 20 in a manner such that the raw material 5 is prevented from being buckled in the axial direction. In FIG. 2, the arrow 50 shows the moving direction of the punch 30 when the raw material 5 is pressed with the punch 30.

Furthermore, the swaging apparatus 2 is equipped with a pressing apparatus (not shown) for giving pressing force to the punch 30. This pressing apparatus is connected to the punch 30 so that pressing force is given to the punch 30 with hydrostatic pressure (e.g., oil pressure, gas pressure) or the like. Furthermore, this pressing apparatus is equipped with a control apparatus (not shown) for controlling the moving rate of the punch 30, i.e., the pressing speed of the raw material 5 by the punch 30.

The guide driving device 40 is a device for moving the guide 20 in a direction opposite to the punch moving direction 50, and is connected to the guide 20. In FIG. 2, the arrow 51 illustrates the moving direction of the guide 20 moved by the guide driving device 40. This guide driving device 40 gives driving force to the guide 20 by hydrostatic pressure (e.g., oil pressure, gas pressure), an electric motor, a spring, or the like (not shown). Furthermore, this guide driving device 40 is equipped with a control apparatus (not shown) for controlling the moving speed of the guide 20.

Next, the forging method using the forging apparatus 1A according to the first embodiment will be explained as follows.

Initially, as shown in FIGS. 1 and 2, the raw material 5 is fixed to the fixing die 10 by fitting the lower end portion of the raw material 5 into the raw material fixing and fitting aperture 12 of the fixing die 10 in a state in which the one end portion (i.e., portion to be enlarged in diameter) of the raw material 5 is protruded upwardly. By fixing the raw material 5 as mentioned above, the raw material 5 becomes immovable in the axial direction thereof. Then, the one end portion of the raw material 5 is inserted into the insertion passage 22 of the guide 20 to thereby hold the one end portion of the raw material 5 in a manner such that the raw material 5 is prevented from being buckled.

Furthermore, an initial clearance X is provided between the guide 20 and the fixing die 10. The distance of the initial clearance X is set to the buckling limit length or less at the cross-sectional area of the exposed portion 8 of the raw material 5 exposed between the guide 20 and the fixing die 10 in the state prior to the initiation of the movement of the punch 30 (i.e., before the pressing of the raw material 5 by the punch 30). In the invention, the buckling limit length denotes a buckling limit length by punch pressing force.

Then, in a state in which the entire periphery of the exposed portion 8 of the raw material 5 exposed between the guide 20 and the fixing die 10 is not restrained, while pressing the raw material 5 with the punch 30 in the axial direction by moving the punch 30, the guide 20 is moved by the guide driving device 40 in a direction opposite to the punch moving direction 50 so that the length of the exposed portion 8 of the raw material 5 becomes the buckling limit length or less at the cross-sectional area of the exposed portion 8 of the raw material 5. At this time, in the first embodiment, a time lag is set between the initiation of the movement of the punch 30 and the initiation of the movement of the guide 20. That is, at the time of pressing the raw material 5 with the punch 30, the position of the guide 20 is fixed, and then the punch 30 is advanced to press the raw material 5 in the axial direction. After the time lag has passed, while pressing the raw material 5 with the punch 30, the guide 20 is moved in a direction 51 opposite to the punch moving direction 50. The moving speed of the guide 20 is controlled by the guide driving device 40 so that the length of the exposed portion 8 of the raw material 5 becomes the buckling limit length or less at the cross-sectional area of the exposed portion 8 of the raw material 5.

In the present invention, the moving speed of the punch 30 can be constant or variable. Similarly, the moving speed of the guide 20 can be constant or variable.

The time lag is set such that the total volume of a volume of the exposed portion 8 of the raw material 5 exposed within the range of the initial clearance X at the time prior to the initiation of the movement of the punch 30 (i.e., at the time prior to the swaging) and an increased volume of the raw material 5 to be increased during the time lag within the range of the initial clearance X does not exceed the volume of the raw material 5 existing within the range of the initial clearance X in the scheduled shape (see FIG. 4) of the enlarged diameter portion 7 of the raw material 5 to be formed by the swaging (i.e., the volume of the cross-hatched portion Z of the enlarged diameter portion 7).

The time lag $t_0$ is represented by $t_0=V_0/(SP)$, where "$V_0$" is an increased volume of the raw material 5 to be increased during the time lag $t_0$ within the range of the initial clearance X, "P" is an average moving speed of the punch 30 from the initiation of the movement, and "S" is a cross-sectional area of the raw material 5 before the swaging.

In accordance with the movement of the punch 30 and that of the guide 20, the one end portion of the raw material 5 is gradually increased in diameter. As shown in FIGS. 3 and 4, when the leading end of the punch 30 has reached the leading end position of the guide 20, the one end portion of the raw material 5 is increased in diameter into a predetermined shape, and the swaging processing of the one end portion of the raw material 5 is completed. Thereafter, the raw material 5 is detached from the fixing die 10. Thus, a predetermined forged product can be obtained.

In the first embodiment, in the state in which the entire periphery of the exposed portion 8 of the raw material 5 exposed between the guide 20 and the fixing die 10 is not restrained, one end portion of the raw material 5 is subjected to swaging processing. Accordingly, this swaging method is classified into a free swaging method. Thus, the one end portion of the raw material 5 can be subjected to the swaging processing under lower forming pressure.

Furthermore, in this swaging method, the swaging processing can be performed without using expensive dies for forming the one end portion of the raw material 5 into a predetermined shape, resulting in reduced manufacturing cost.

Furthermore, the swaging processing of the one end portion of the raw material 5 is performed while pressing the raw material 5 by moving the guide 20 in a direction 51 opposite to the punch moving direction 50 so that the length of the exposed portion 8 of the raw material 5 becomes the buckling limit length or less at the cross-sectional area of the exposed portion 8 of the raw material 5. Therefore, the occurrence of buckling of the raw material 5 which may sometimes be occurred due to the pressing force against the raw material 5 by the punch 30 can be prevented.

Furthermore, the initial clearance X having a predetermined distance is provided between the guide 20 and the fixing die 10. Therefore, the buckling of the exposed portion 8 of the raw material 5 exposed within the range of the initial clearance X between the guide 20 and the fixing die 10 can be prevented immediately after the initiation of the movement of the punch 30, and further the moving length (stroke) of the guide 20 can be shortened.

Furthermore, the time lag from the initiation of the movement of the punch 30 to the initiation of the movement of the guide 20 is set such that the total volume of a volume of the exposed portion 8 of the raw material 5 exposed within the range of the initial clearance X at the time prior to the initiation of the movement of the punch 30 and an increased volume of the raw material 5 to be increased during the time lag within the range of the initial clearance X does not exceed the volume of the raw material 5 existing within the range of the initial clearance X in the scheduled shape of the enlarged diameter portion 7 of the raw material 5 to be formed by the swaging. Therefore, the one end portion of the raw material 5 can be assuredly increased in diameter into a predetermined shape.

Accordingly, in the forging method according to the first embodiment, a high quality forged product (swaged product) can be obtained at low cost.

Furthermore, since the edge portion of the leading end surface of the guide 20 at the side of the insertion passage 22 is beveled, the guide 20 can effectively receive the back pressure from the exposed portion 8 of the raw material 5 at the time of swaging. Thus, in the guide driving device 40 for moving the guide 20, the driving force required to move the guide 20 can be decreased, and therefore the guide 20 can be moved with the guide driving device 40 having smaller driving force.

Next, preferable processing conditions for the forging method of this embodiment will be explained. In the following explanation, P, G, $X_0$, $X_1$, X, $t_0$ and T denote as follows:

"P" is the average moving speed of the punch 30 from the initiation of the movement;

"G" is the average moving speed of the guide 20 from the initiation of the movement;

"$X_0$" is the buckling limit length at the cross-sectional area of the raw material 5 before the swaging processing;

"$X_1$" is the buckling limit length at the cross-sectional area of the enlarged diameter portion 7 of the raw material 5 after the swaging processing;

"X" is the initial clearance between the guide 20 and the fixing die 10 ($0 \leqq X \leqq X_0$);

"$t_0$" is the time lag from the initiation of the movement of the punch 30 to the initiation of the movement of the guide 20 ($0 \leqq t_0$);

"L" is the length of the enlarged diameter portion 7 of the raw material 5 after the swaging processing;

"$l_0$" is the length of the raw material 5 before the swaging processing required for the enlarged diameter portion 7; and "T" is the swaging processing time from the initiation of the movement of the punch 30.

In the forging method of this embodiment if $t_0$<T, it is preferable that "G" satisfies the following relational expression:

$$(L-X)/[(l_0-L)/P-t_0] \leqq G \leqq P(X_1-X)/(l_0-X_1-Pt_0) \quad \text{(i)}$$

When "G" satisfies the aforementioned relational expression (i), it is possible to prevent a problem that there remains an un-enlarged diameter portion at one end portion of the raw material 5 when the movement of the punch 30 is completed (i.e., when the swaging processing is completed), which in turn assuredly enables the one end portion of the raw material 5 to be enlarged in diameter into the predetermined shape. It is also possible to assuredly prevent the occurrence of buckling of the raw material which may sometimes be generate during the swaging processing.

The reasons for setting the aforementioned relational expression for "G" in the aforementioned relational expression will be explained as follows.

<Lower Limit of "G">

In cases where the leading end of the guide 20 is located at a portion lower than the position of the leading end of the punch 30 when the movement of the punch 30 is completed, a non-processed portion remains at the one end portion of the raw material 5. In this situation, the one end portion of the raw material 5 cannot be enlarged in diameter into the scheduled shape. In order to solve such a problem, it is necessary that the position of the leading end of the guide 20 and that of the punch 30 coincide with each other when the movement of the punch 30 is completed. That is, at the lower limit of "G," it is necessary that the time $(l_0-L)/P$ required for the punch 30 to move from the height position of $l_0$ to the height position of "L" is equal to the time required that the distance between the guide 20 and the fixing die 10 becomes from X to L by the movement of the guide 20. Accordingly, "G" is required to satisfy the following relational expression:

$$(L-X)/[(l_0-L)/P-t_0] \leqq G \quad \text{(i-a)}$$

<Upper Limit of "G">

The condition of the upper limit of "G" is that the length of the exposed portion 8 of the raw material 5 when the leading end position of the guide 20 and that of the punch 30 coincide with each other is the buckling limit length or less at the cross-sectional area of the exposed portion 8 of the raw material 5.

When the leading end position of the guide 20 and that of the punch 30 coincide, the following equation (i-b) is satisfied.

$$l_0-PT=X+G(T-t_0) \quad \text{(i-b)}$$

From the above equation (i-b), T is represented by the following equation (i-c).

$$T=[l_0-X+Gt_0]/(G+P) \quad \text{(i-c)}$$

Furthermore, in order to prevent the occurrence of buckling of the raw material 5, it is required that the length $X+G(T-t_0)$ of the exposed portion 8 of the raw material 5 when the leading end of the guide 20 coincides with the leading end of the punch 30 is the buckling limit length $X_1$ or less at the cross-sectional area of the enlarged diameter portion 7 of the raw material 5 at the time of the completion of the swaging processing (i.e., at the time of the completion of the movement of the punch 30). Therefore, the following equation (i-d) is satisfied.

$$X+G(T-t_0) \leqq X_1 \quad \text{(i-d)}$$

By substituting the aforementioned equation (i-c) for the aforementioned inequality (i-d), the following relational expression (i-e) can be obtained.

$$G \leqq P(X_1-X)/(l_0-X_1-Pt_0) \quad \text{(i-e)}$$

From the aforementioned inequalities (i-a) and (i-e), the aforementioned relational expression (i) can be obtained.

In the aforementioned relational expression (i), if "G" is less than the lower limit, a problem that some of the one end portion of the raw material 5 remains un-enlarged in diameter at the time of the completion of the movement of the punch 30 (i.e., at the time of the completion of the swaging processing) will be generated. As a result, the end portion of the raw material 5 cannot be enlarged in diameter into a scheduled shape. To the contrary, if "G" exceeds the upper limit, a problem that the exposed portion 8 of the raw material 5 will be buckled at the time of swaging processing. Accordingly, it is preferable that "G" satisfies the aforementioned relational expression (i).

In the case of $0 \leqq T \leqq t_0$, G is zero (G=0).

In the present invention, it is especially preferable that the time lag $t_0$ is larger than zero, $0<t_0$. The reason is as follows. That is, in the case of $0<t_0$, at the time immediately after the initiation of the movement of the punch 30 (i.e., at the time immediately after the initiation of the swaging processing), the exposed portion 8 of the raw material 5 exposed within the range of the initial clearance X between the guide 20 and the fixing die 10 increases in diameter. This increases the buckling limit length of the exposed portion 8 of the raw material 5, and therefore the occurrence of buckling can be assuredly prevented.

In the present invention, however, it is not necessarily required to set a time lag $t_0$, in other words, the time lag $t_0$ can be zero, i.e., $t_0=0$.

Furthermore, in the present invention, in cases where the cross-section of the enlarged diameter portion 7 of the raw material 5 is not constant along the axial direction thereof after the swaging processing, it is preferable that a cross-sectional area considering the shape of the enlarged diameter portion 7 is employed as a cross-sectional area of the enlarged diameter portion 7 of the raw material 5 at the time of the completion of the swaging processing. For example, an average cross-sectional diameter of the enlarged diameter portion 7 is preferably employed. Other than the above, a minimum or maximum cross-sectional area of the enlarged diameter portion 7 can be employed.

Figure 5:
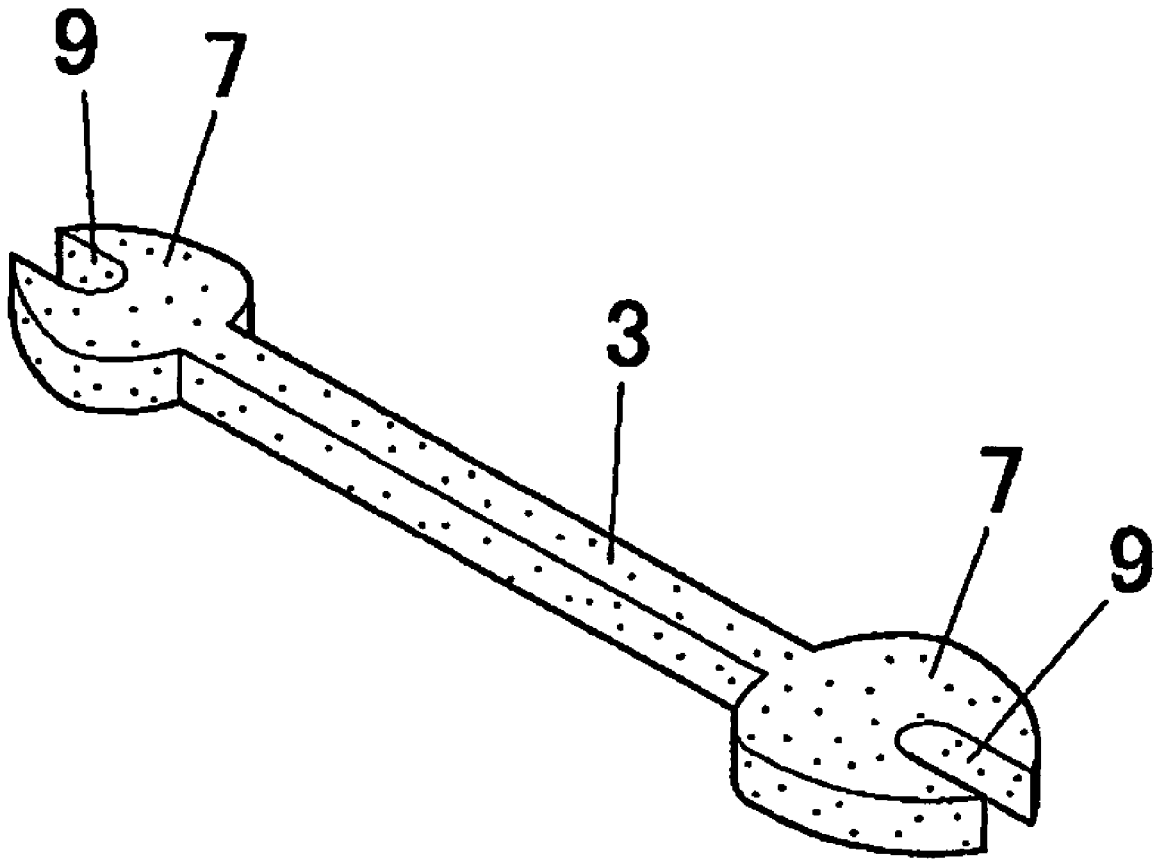
FIG. 5 is a schematic view showing a forged product manufactured by the forging apparatus according to the second embodiment of the present invention.
Figure 6:
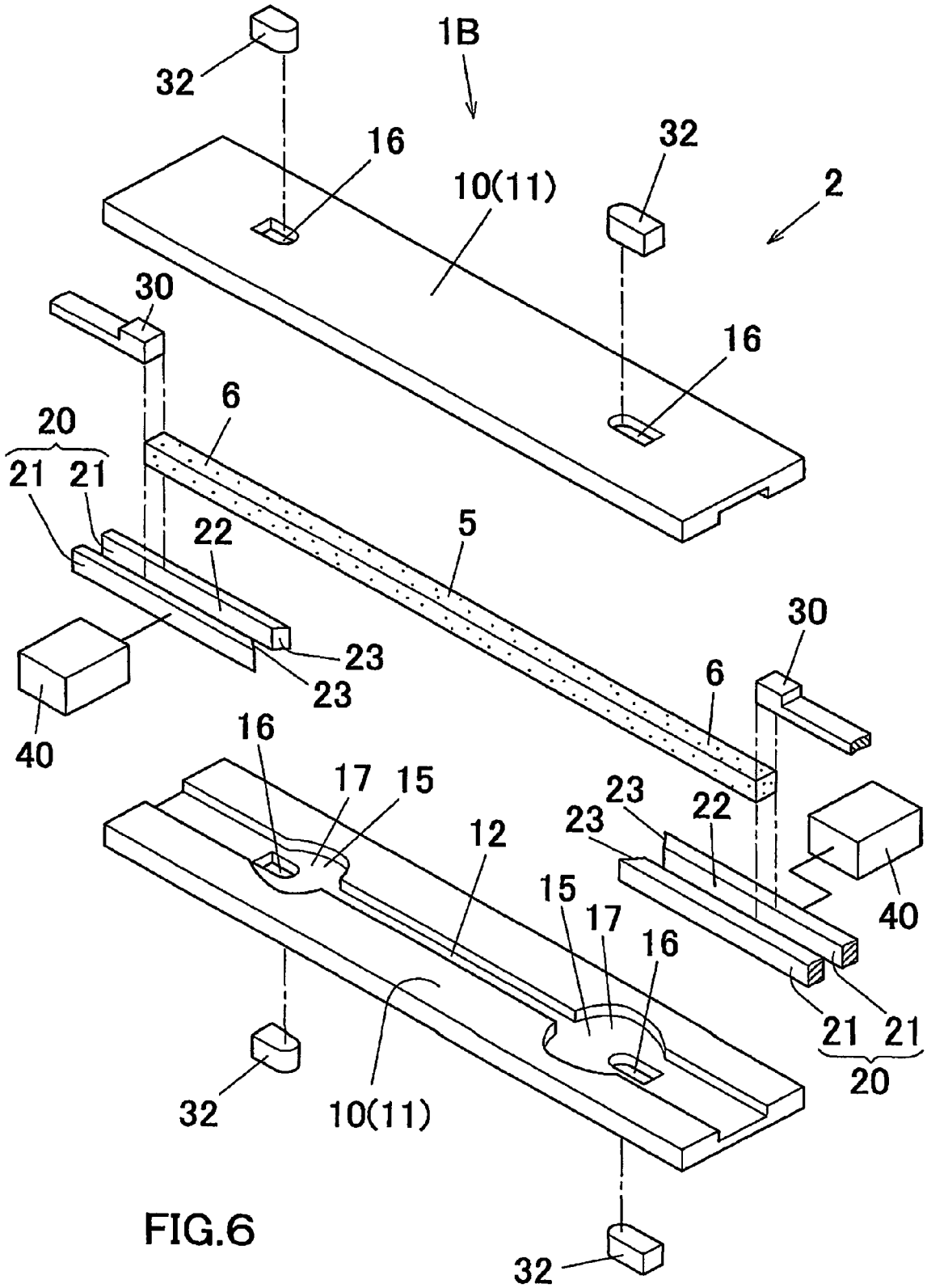
FIG. 6 is an exploded view showing the forging apparatus.

FIGS. 5 to 13 are schematic views for explaining a forging method using a forging apparatus according to a second embodiment of the present invention. In FIG. 6, the reference numeral "1B" denotes a forging apparatus of the second embodiment, and "5" denotes a raw material. In FIG. 5, the reference numeral "3" denotes a forged product manufactured by the forging apparatus 1B.

Figure 9:
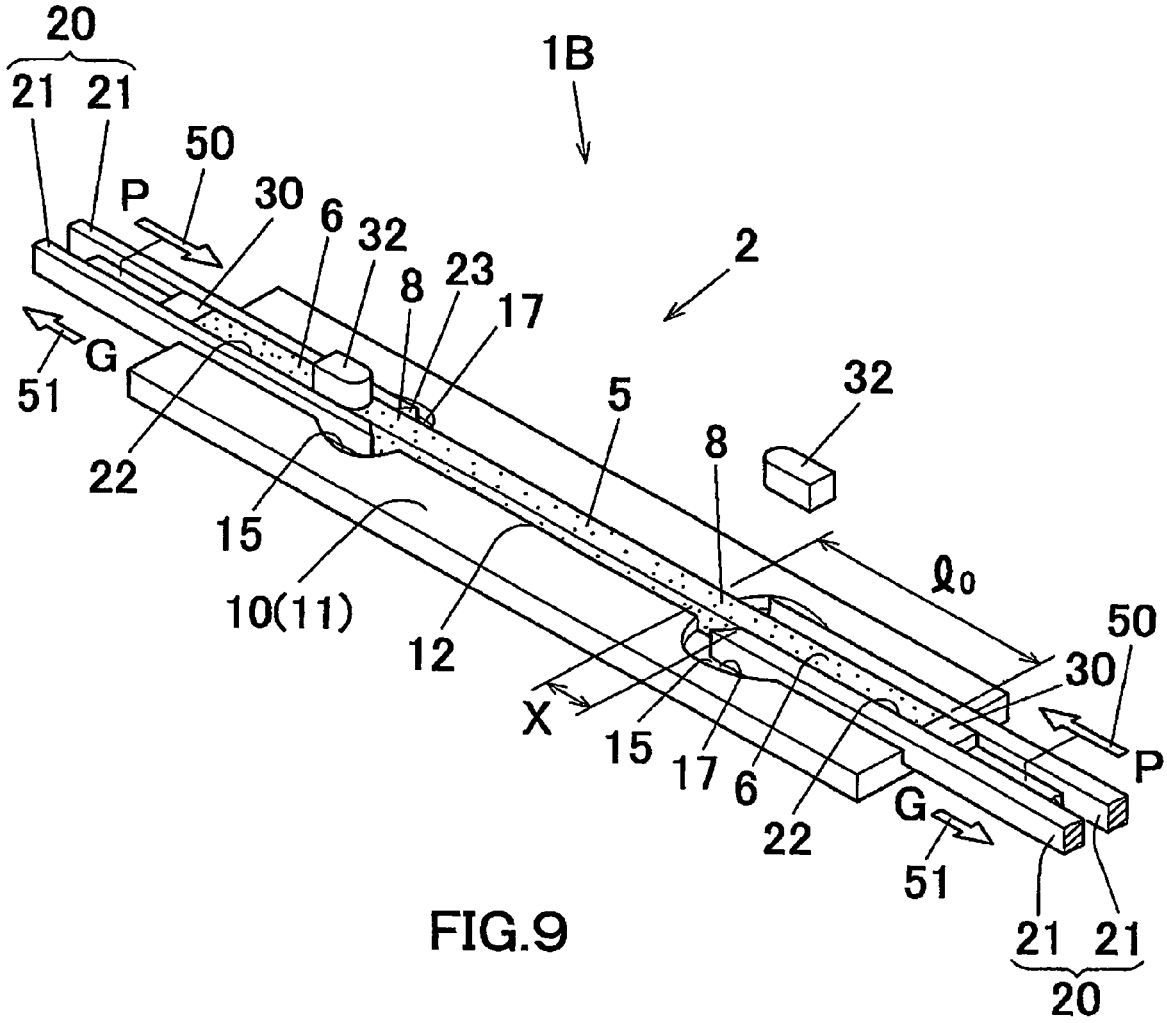
FIG. 9 is a schematic view showing the forging apparatus shown in FIG. 7 in a state in which the upper fixing die among two separated fixing dies is removed.
Figure 10:
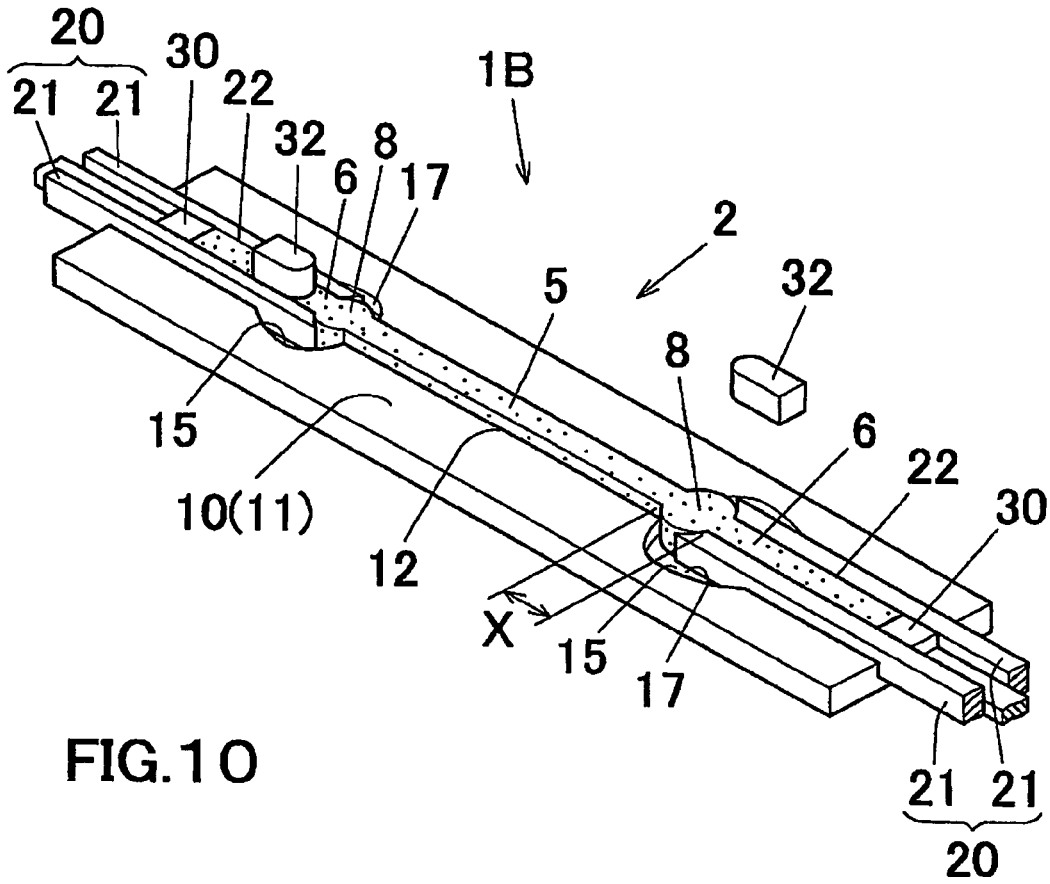
FIG. 10 is a schematic view showing a state in which swaging processing is being subjected to both end portions of the raw material with the forging apparatus.

As shown in FIG. 6, the raw material 5 is a straight bar-shaped member similar to the raw material in the aforementioned first embodiment. The cross-section of the raw material 5 is square. In this raw material 5, the scheduled enlarged diameter portions 6 of the raw material 5 are one end portion of the raw material 5 and the other end portion thereof. In FIG. 9, "$l_0$" denotes the length of the non-swaged raw material 5 required for the enlarged diameter portion 7. The other structures of this raw material 5 are the same as those in the first embodiment.

The forged product 3 is a product to be used as a spanner (wrench) (in detail, double-end spanner (wrench)) as shown in FIG. 5, and is manufactured by enlarging the one end portion of the raw material 5 and the other end portion thereof into an enlarged diameter portion 7 having a flat shape with a prescribed thickness respectively and then subjecting each enlarged diameter portion 7 to a secondary forging processing. That is, this forged product 3 is a bar-shaped product with enlarged diameter portions 7 and 7 at both ends. The enlarged diameter portion 7 formed at one end portion of this forged product 3 and that formed at the other end portion are different in size.

As shown in FIG. 6, in the forging apparatus 1B, the fixing die 10 is provided with a raw material fixing and fitting dented portion 12 in which the raw material 5 is fitted in a fixed manner. Furthermore, the fixing die 10 is comprised of a plurality of divided dies divided at the dividing face dividing the raw material fixing and fitting dented portion 12 along the length thereof. In this second embodiment, the fixing die 10 is divided into an upper fixing die 11 and a lower fixing die 11. These two fixing dies 11 and 11 are same in structure.

In FIGS. 9 to 13, for the sake of explanation, the upper fixing die 11 among the fixing dies 11 and 11 is omitted.

In this fixing die 10, the axial central portion of the raw material 5 is fitted in the raw material fixing and fitting dented portion 12 with both end portions of the raw material 5 protruded in the opposite directions. In the state in which the raw material 5 is fitted in the raw material fixing and fitting dented portion 12, the one end portion of the raw material 5 and the other end portion thereof are simultaneously subjected to swaging processing, causing the raw material 5 to be fixed to the fixing die 10 so as not to be moved in the axial direction at the time of swaging pressing. At the one end portion of the fixing die 10 and the other end portion thereof, a restraining die portion 15 is integrally formed respectively. The structure of the retraining die portion 15 will be explained later.

The forging apparatus 1B is equipped with two guides 20 and 20 and two punches 30 and 30 for swaging two portions, i.e., one end portion of the raw material 5 and the other end portion thereof.

Each guide 20 has a passage 22 for holding the raw material 5 in a buckling preventing manner as shown in FIG. 6. In the second embodiment, the guide 20 is constituted by a pair of guide members 21 and 21 disposed at a certain distance at both sides of the insertion passage 22.

The edge portions of the leading end surface of the guide 20 are beveled at the sides of the passage 22, and therefore the edge portions are rounded. In the second embodiment, the entire leading edge surface of the guide 20 is formed into a concave surface. In FIG. 6, the reference numeral "23" denotes a beveled portion. The other structures of this guide 20 are the same as those in the first embodiment.

To each guide 20, a guide driving device 40 is connected. The structure of the guide driving device 40 is the same as that in the aforementioned first embodiment.

To each punch 30, a pressing device (not shown) for giving pressing force to the punch 30 is connected. The structure of the punch 30 and that of the pressing device are the same as that in the aforementioned first embodiment.

As shown in FIGS. 6 and 9, the restraining die portions 15 and 15 of the upper and lower fixing dies 11 and 11 constituting the fixing die 10 are used to restrain a part of the periphery of the exposed portion 8 of the raw material 5 exposed between the guide 20 and the fixing die 10. In this second embodiment, the restraining die portion 15 restrains the exposed portion 8 by contacting the thickness sides of the exposed portion 8.

The restraining die portion 15 is provided with a forming dented portion 17. In this second embodiment, a part of the forming surface of the forming dented portion 17 (more specifically, the side surface of the forming dented portion 17)

constitutes a restrain functioning surface of the restraining die portion 15. This forming dented portion 17 is closed, i.e., the forming dented portion 17 of the restraining die portion 15 is not provided with a flash forming dented portion.

Furthermore, as shown in FIG. 6, each restraining die portion 15 is provided with a second punch fitting aperture 16. In this second punch fitting aperture 16, a second punch is 32 is fitted. In the state in which the second punch 32 is fitted in the fitting aperture 16, the leading end surface of the second punch 32 is flush with the restrain functioning surface of the restraining die portion 15. This second punch 32 is moved toward the forming dented portion 17 to press the enlarged diameter portion 7 of the raw material 5 (see FIG. 13). The pressing of the enlarged diameter portion 7 of the raw material 5 by the second punch 32 causes the forming dented portion 17 to be filled with the material of the enlarged diameter portion 7. To the second punch 32, a second pressing apparatus (not shown) for giving pressing force to the second punch 32 is connected. This second pressing apparatus is driven by, for example, fluid pressure (oil pressure or gas pressure) to give pressing force to the second punch 32.

In FIGS. 9 to 13, for the sake of explanation, the right side second punch 32 is illustrated with the position shifted upwardly.

Hereinafter, a forging method using the forging apparatus 1B of the second embodiment will be explained.

Figure 7:
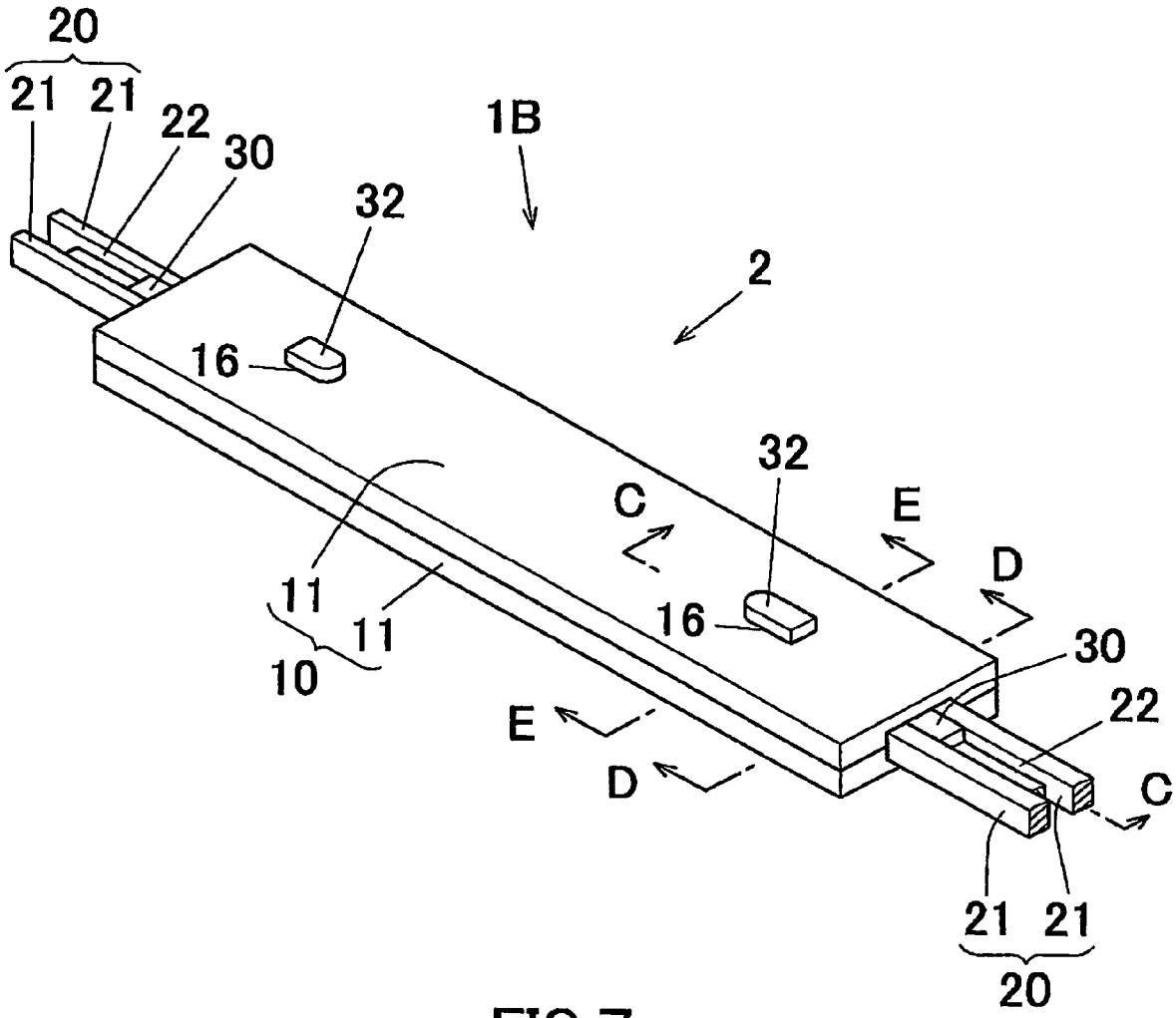
FIG. 7 is a schematic view showing the state before subjecting both end portions of a raw material to swaging by the forging apparatus.
Figure 8A:
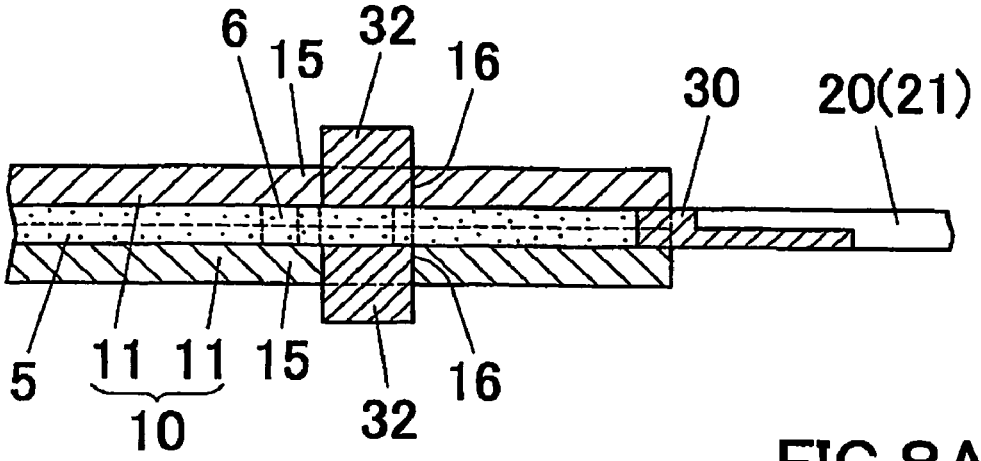
FIG. 8A is a cross-sectional view taken along the line C-C in FIG. 7.
Figure 8B:
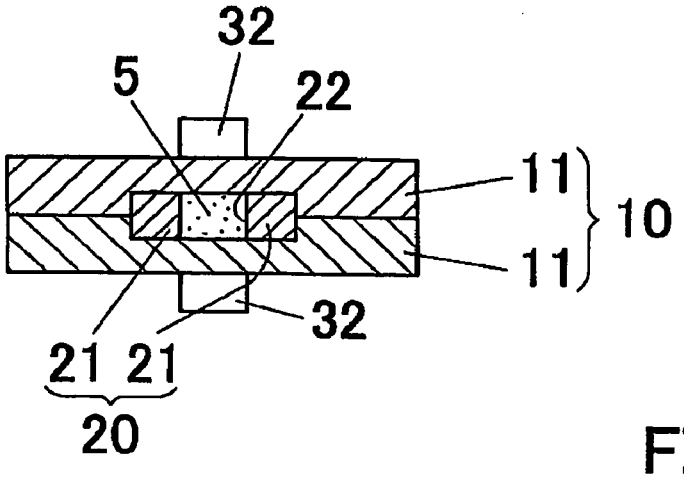
FIG. 8B is a cross-sectional view taken along the line D-D in FIG. 7.
Figure 8C:
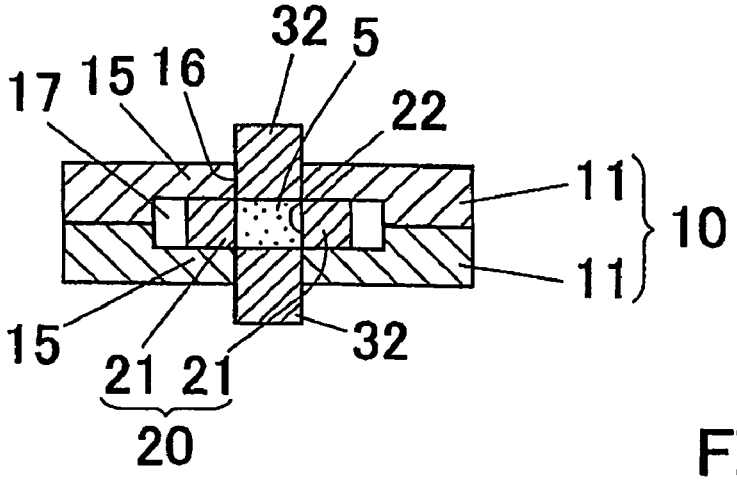
FIG. 8C is a cross-sectional view taken along the line E-E in FIG. 8.

As shown in FIGS. 7 to 9, the axial central portion of the raw material 5 is fitted in the raw material fixing and fitting dented portion 12 of the fixing die 10, and the raw material 5 is fixed to the fixing die 10 with both end portions as scheduled enlarged diameter portions 6 protruded. The one end portion of the raw material 5 and the other end portion thereof are inserted in the respective corresponding passages 22 of the guides 20, to thereby hold the one end portion of the raw material 5 and the other end portion thereof in a buckling preventing state. In this state, the leading end surface of the second punch 32 is flush with the restrain functioning surface of the restraining die portion 15 (see FIG. 8C).

Then, as shown in FIG. 9, an initial clearance X is provided between the guide 20 and the fixing die 10. The distance (range) of this initial clearance X is set to be the buckling limit length or less at the cross-sectional area of the exposed portion 8 of the raw material 5 exposed between the guide 20 and the fixing die 10 in the state prior to the initiation of the movement of the punch 30 (i.e., the initiation of the pressing of the raw material 5 by the punch 30) in the same manner as in the aforementioned first embodiment.

Then, in the state in which a part of the periphery of the exposed portion 8 of the raw material 5 is restrained by the restraining die portion 15 between the guide 20 and the fixing die 10, while pressing the raw material 5 in the axial direction with the punch 30 by simultaneously moving both punches 30 and 30, both guides 20 and 20 are moved in a direction 51 opposite to the corresponding punch moving direction 50 so that the length of the exposed portion 8 of the raw material 5 becomes the buckling limit length or less at the cross-sectional area of the exposed portion 8 of the raw material 5. At this time, a time lag is set between the initiation of the movement of each punch 30 and the initiation of the movement of each guide 20. In detail, at the time of initiating the pressing of the raw material 5 by the punch 30, the position of each guide 20 is fixed, and then the raw material 5 is pressed in the axial direction by each punch 30 by moving the punch 30. This causes the exposed portion 8 of the raw material 5 exposed between the guide 20 and the fixing die 10 (i.e., within the range of the initial clearance X) to be enlarged in diameter.

After the time lag has passed, while continuously pressing the raw material 5 with each punch 30, each guide 20 is moved in the direction 51 opposite to the punch moving direction 50. In the case of moving the guide 20, the moving speed of each guide 20 is controlled by each guide driving device 40 such that the length of the exposed portion 8 of the raw material 5 becomes the buckling limit length or less at the cross-sectional area of the exposed portion 8 of the raw material 5.

The time lag is set such that the total volume of a volume of the exposed portion 8 of the raw material 5 exposed within the range of the initial clearance X at the time prior to the initiation of the movement of the punch 30 (i.e., prior to the swaging processing) and an increased volume of the raw material 5 to be increased during the time lag within the range of the initial clearance X does not exceed the volume of the raw material 5 existing within the range of the initial clearance X in the scheduled shape (see FIG. 12) of the enlarged diameter portion 7 of the raw material 5 to be formed by the swaging processing.

Figure 11:
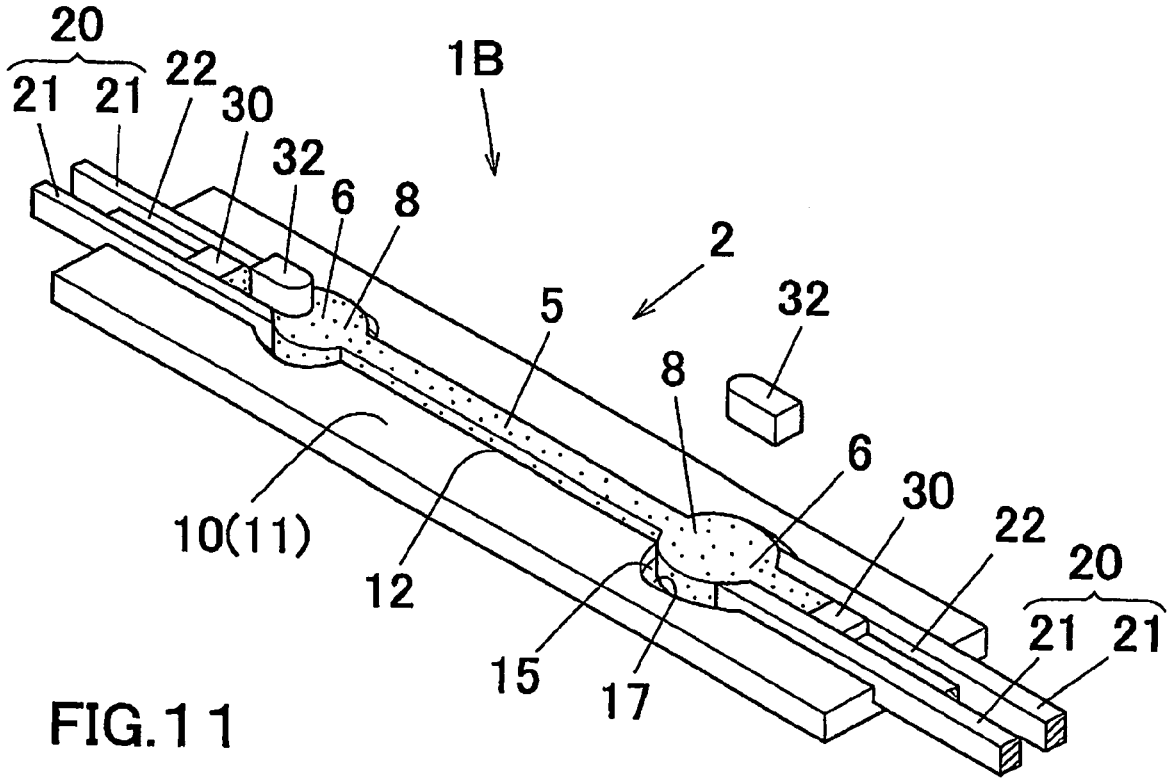
FIG. 11 is a schematic view showing another state in which the swaging processing is being subjected to both end portions of the raw material with the forging apparatus.
Figure 12:
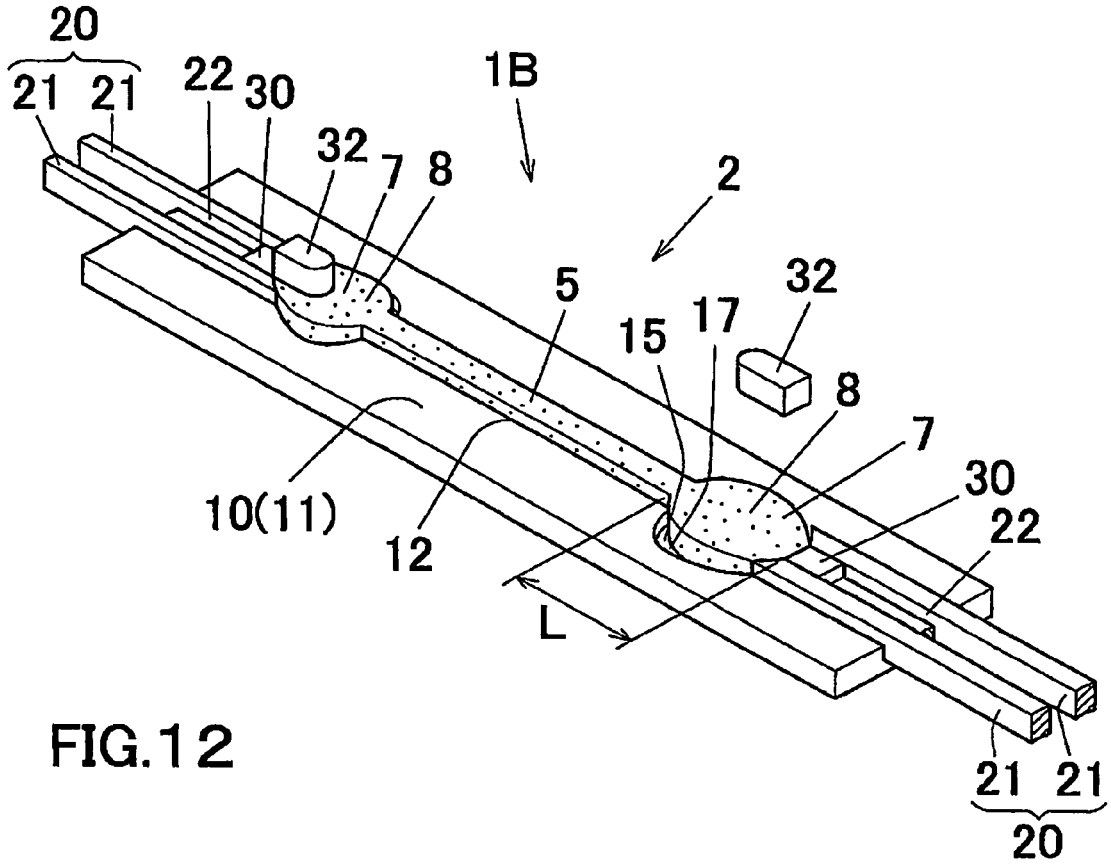
FIG. 12 is a schematic view showing the state after the swaging was subjected to both end portions of the raw material with the forging apparatus.

In accordance with the movements of the punches 30 and the guides 20 and 20, as shown in FIG. 11, the one end portion of the raw material 5 and the other end portion thereof are gradually simultaneously increased in diameter. As shown in FIG. 12, when the leading end of each punch 30 has reached the leading end position of the corresponding guide 20, the one end portion of the raw material 5 and the other end portion thereof are simultaneously enlarged in diameter into a scheduled approximately round plate shape (enlarged diameter portion 7), respectively, and thus the swaging processing of the one end portion of the raw material 5 and the other end portion thereof is completed. The reference letter "L" denotes the length of the enlarged diameter portion 7 of the raw material 5 after the swaging processing. The obtained raw material 5 shown in FIG. 12 becomes a preform of the forged product 3 of a scheduled design shape shown in FIG. 5.

Figure 13:
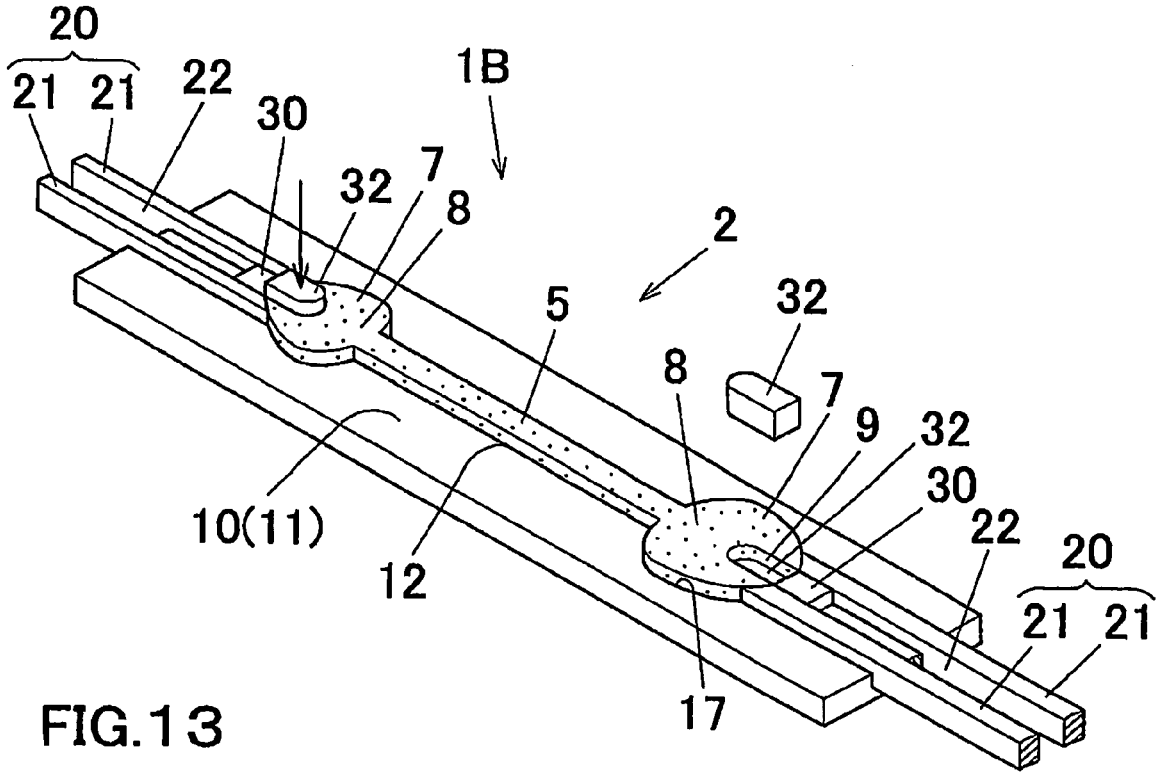
FIG. 13 is a schematic view showing the state after pressing the enlarged diameter portion of the raw material with the forging apparatus.

Thereafter, as shown in FIG. 13, both the enlarged diameter portion 7 and 7 of the raw material 5 are pressed simultaneously in the thickness direction with both the second punches 32 and 32 to thereby fill the forming dented portion 17 with the material of the enlarged diameter portions 7, respectively, by deforming the enlarged diameter portion 7 within the forming dented portion 17, respectively. Each second punch 32 also functions as a forming protruded portion. Therefore, by pressing the enlarged diameter portion 7 with the second punch 32, a dented portion 9 corresponding to the second punch 32 is formed on each of both surfaces of the enlarged diameter portion 7 in the thickness direction. In the second embodiment, the dented portions 9 are formed so as to penetrate the enlarged diameter portion 7 in the thickness direction.

By the aforementioned processing, the forged product 3 of the scheduled design shape shown in FIG. 5 is manufactured.

The forging method of the second embodiment has the following advantages in addition to the advantages of the first embodiment.

Since the swaging processing is executed simultaneously to the one end portion of the raw material 5 and the other end portion thereof, the processing efficiency of the swaging processing can be enhanced.

Furthermore, the forged product 3 of the scheduled design shape can be obtained without removing the raw material 5 from the fixing die 10 or attaching another die after the execution of the swaging processing of the one and the other end portions of the raw material 5. Accordingly, the number of dies or processing steps can be decreased, resulting in reduced manufacturing cost.

Furthermore, since the forming dented portion 17 is closed, it is not required to perform flash removing processing after the completion of the forming processing. Therefore, the processing steps can be further decreased, and the product yield rate can be improved.

In the forging method of the second embodiment, in the same manner as in the aforementioned first embodiment, in the case of $t_0<T$, it is preferable that the average moving speed G of the guide 20 satisfies the aforementioned relational expression (i).

In the present invention, it is not necessarily required to set a time lag $t_0$, in other words, the time lag can be zero, i.e., $t_0=0$.

Figure 14:
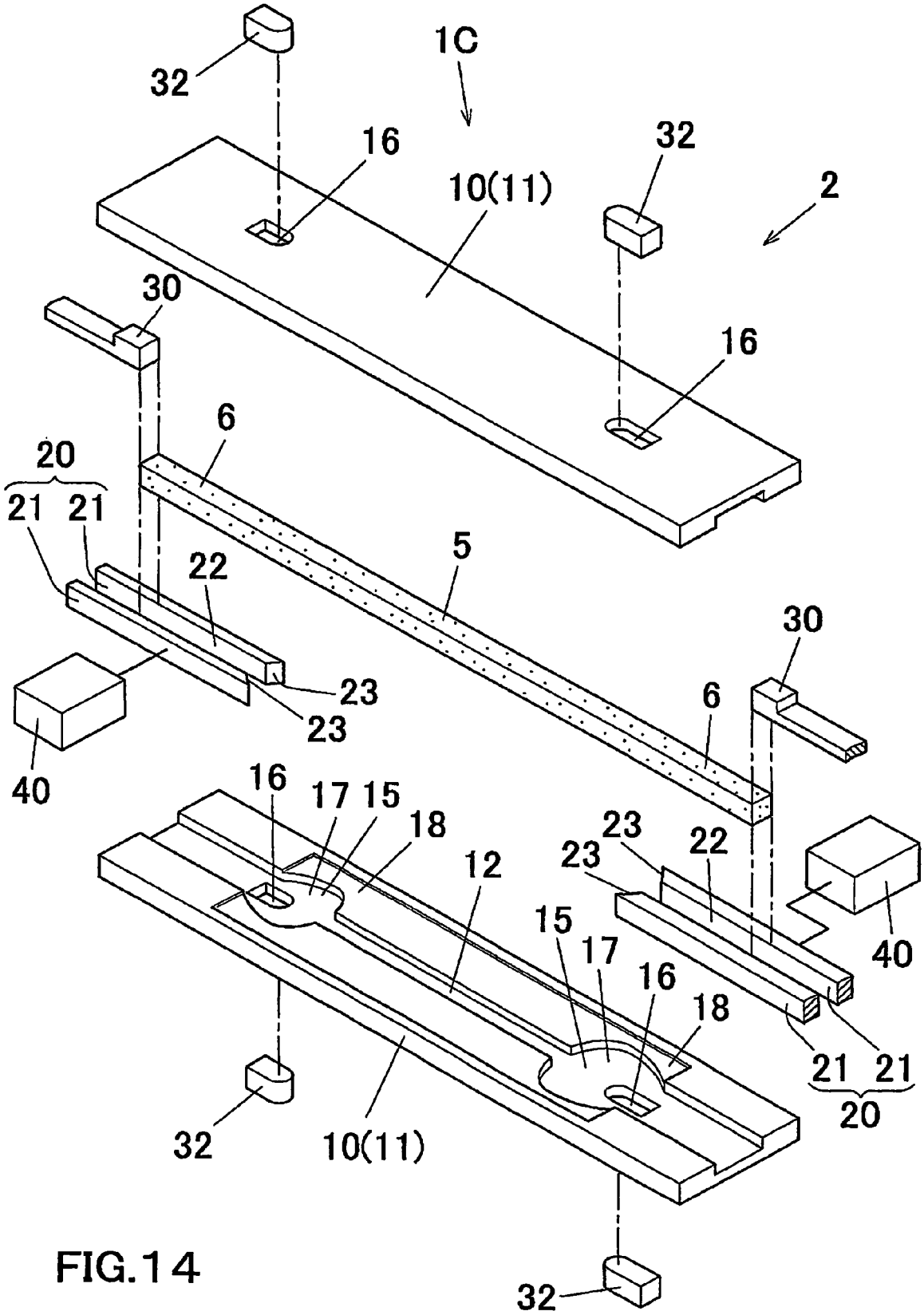
FIG. 14 is an exploded schematic view of a forging apparatus according to a third embodiment of the present invention.
Figure 15:
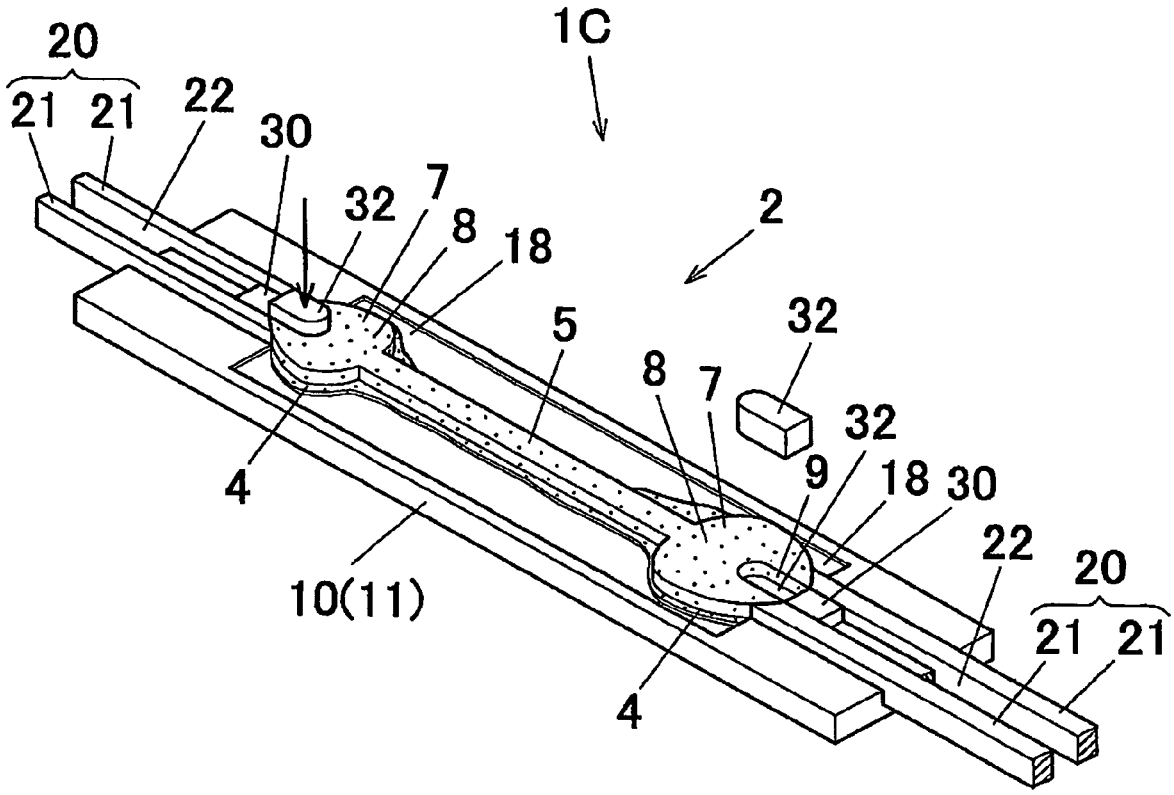
FIG. 15 is a schematic view corresponding to FIG. 13 and showing the state after pressing the enlarged diameter portions of the raw material with the forging apparatus.

FIGS. 14 and 15 are schematic views for explaining a forging method using a forging apparatus according to a third embodiment of the present invention. In FIG. 14, the reference numeral "1C" denotes a forging apparatus of the third embodiment, and "5" denotes a raw material.

The forging apparatus 1C of the third embodiment is an apparatus to be used for manufacturing the forged product 3 shown in FIG. 5. In this forging apparatus 1C, in the fixing die 10 and the restraining die portion 15, a flash forming dented portion 18 continuing from the forming dented portion 17 is provided. That is, this forming dented portion 17 is semi-closed (semi-sealed). The other structures of this forging apparatus 1C are the same as those of the second embodiment.

In FIG. 15, for the sake of explanation, the upper fixing die 11 among the upper fixing die 11 and the lower fixing die 12 constituting the fixing die 10 is omitted. Furthermore, in this figure, the second punch 32 is illustrated in a manner shifted to the right upper side.

In this forging apparatus 1C, as shown in FIG. 15, after simultaneously performing the swaging processing to the one end portion of the raw material 5 and the other end portion thereof, both the enlarged diameter portions 7 and 7 of the raw material 5 are simultaneously pressed with both the second punches 32 and 32, to thereby fill the forming dented portions 17 and 17 and the flash forming dented portion 18 with the material of the enlarged diameter portions 7 and 7 by plastically deforming the enlarged diameter portions 7 and 7 within the corresponding forming dented portion 17. Thus, a forged product with a flash 4 can be manufactured as a forged product having a shape approximate to the scheduled design shape. Thereafter, by removing the flash 4, the forged product 3 of the scheduled design shape shown in FIG. 5 can be obtained.

According to the forging method of the third embodiment since the material of the enlarged diameter portion 7 of the raw material 5 is filled into the forming dented portions 17 and 17 and the flash forming dented portion 18 by pressing the enlarged diameter portion 7 of the raw material 5 with the second punches 32 and 32, the processing of the enlarged diameter portion 7 of the raw material 5 can be performed under lower forming pressure. Furthermore, the load to be applied to the forming dented portion 17 at the time of processing can be decreased, resulting in an extended life of the forming dented portion 17.

In the forging method of the third embodiment, in the same manner as in the aforementioned first embodiment, in the case of $t_0<T$, it is preferable that the average moving speed G of the guide 20 satisfies the aforementioned relational expression (i).

Figure 16:
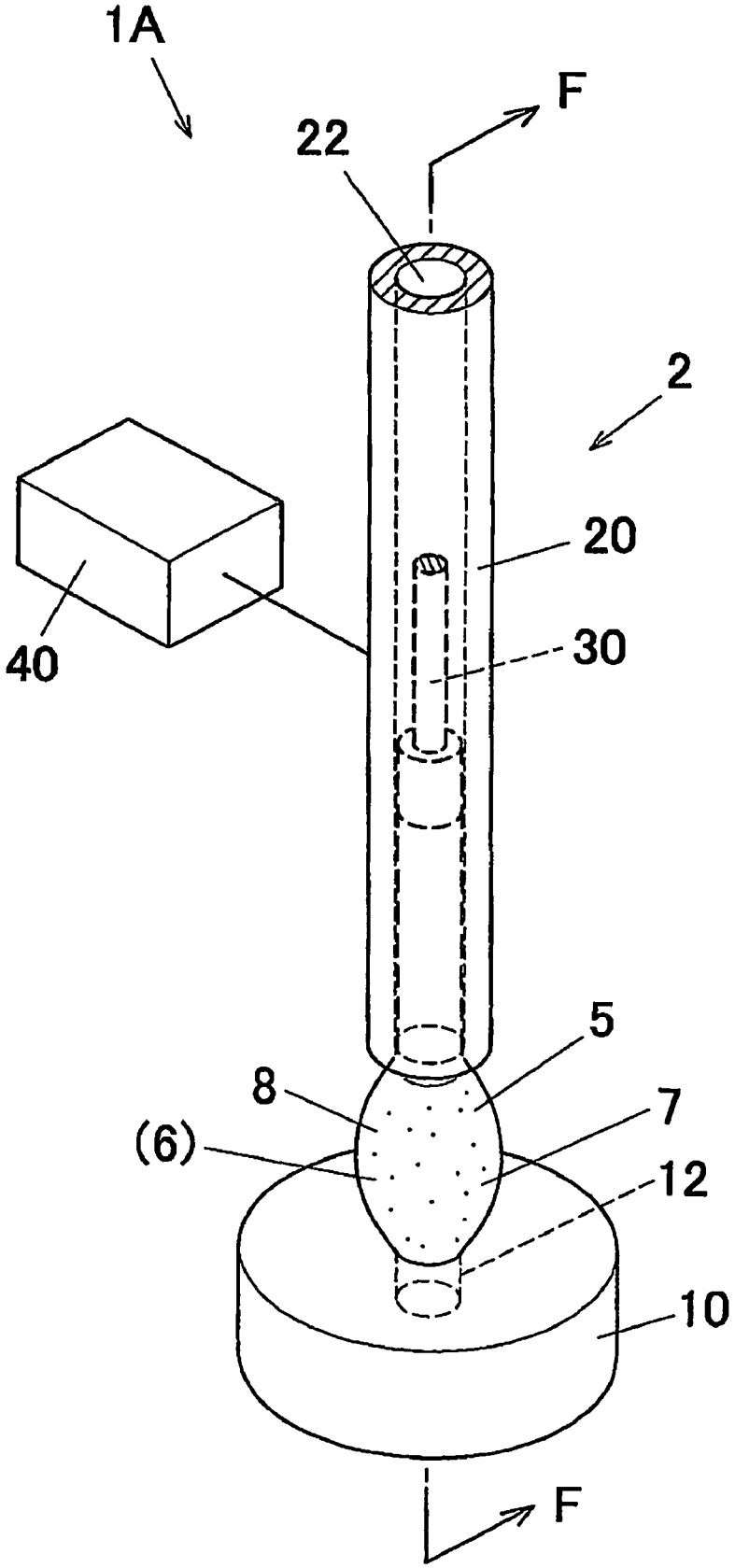
FIG. 16 is a schematic view showing the state after subjecting the axial central portion of the raw material to swaging by the forging apparatus according to the first embodiment.
Figure 17:
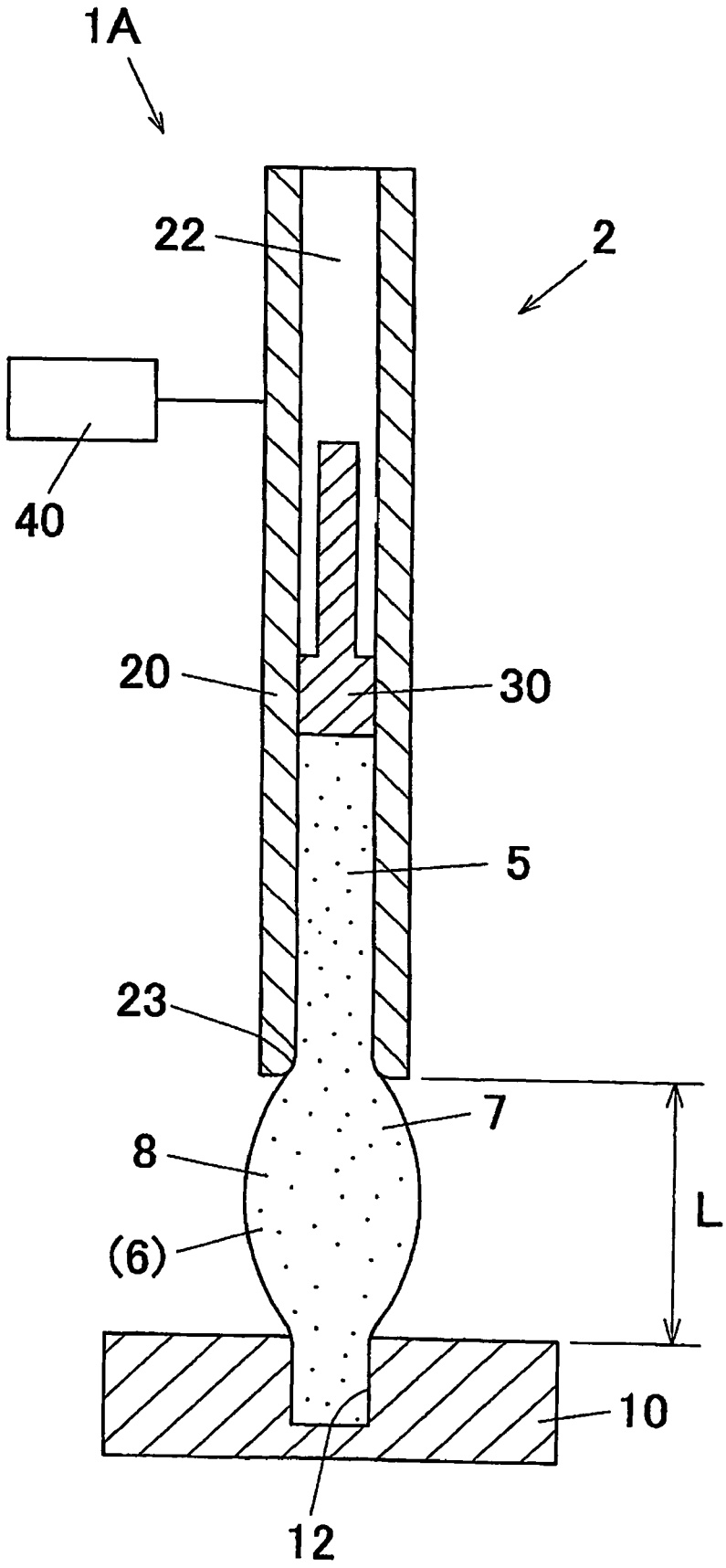
FIG. 17 is a cross-sectional view taken along the line F-F in FIG. 16.

FIGS. 16 and 17 show the state after swaging processing is performed to the axial central portion of the raw material 5 by the forging apparatus 1A according to the first embodiment 1A. The scheduled enlarged diameter portion 6 of the raw material 5 is an axial central portion of the raw material 5. In this case, the forging method is performed as follows.

First, the lower end portion of the raw material 5 is filed in the raw material fixing and fitting aperture 12 of the fixing die 10 so that the raw material 5 is fixed to the fixing die 10 with the region from the axial central portion (scheduled enlarged diameter portion 6) of the raw material 5 to the upper end thereof upwardly protruded. Then, the region from the axial central portion (scheduled enlarged diameter portion 6) of the raw material 5 to the upper end thereof is inserted into the insertion passage 22 of the guide 20 to thereby hold the axial central portion of the raw material 5 by the guide 20 in a buckling preventing manner.

Thereafter, an initial clearance X is formed between the guide 20 and the fixing die 10 (see FIGS. 1 and 2). In the same manner as in the first embodiment, this clearance X is set to the buckling limit length or less at the cross-sectional area of the exposed portion 8 of the raw material 5 exposed between the guide 20 and the fixing die 10 in the state prior to the initiation of the movement of the punch 30 (i.e., the pressing of the raw material 5 by the punch 30).

Then, in the state in which the entire periphery of the exposed portion 8 of the raw material 5 exposed between the guide 20 and the fixing die 10 is not restrained, while pressing the raw material 5 with the punch 30 in the axial direction by moving the punch 30, the guide 20 is moved with the guide driving device 40 in a direction opposite to the punch moving direction such that the length of the exposed portion 8 of the raw material 5 becomes the buckling limit length or less at the cross-sectional area of the exposed portion 8 of the raw material 5. At this time, a time lag is set between the initiation of the movement of the punch 30 and the initiation of the movement of the guide 20.

In accordance with the movements of the punch 30 and the guide 20, the one end portion of the raw material 5 is gradually enlarged in diameter. As shown in FIGS. 16 and 17, when the leading end of the punch 30 has reached a predetermined height position, the axial central portion of the raw material 5 is enlarged in diameter into the scheduled spindle shape (the enlarged diameter portion 7). Thus, the swaging processing of the axial central portion of the raw material 5 is completed. By taking the raw material 5 out of the fixing die 10, a desired forged product can be obtained.

In the forging method of this embodiment, in the same manner as in the aforementioned first embodiment, in the case of $t_0<T$, it is preferable that the average moving speed G of the guide 20 satisfies the aforementioned relational expression (i).

Although several preferable embodiments of the present invention have been explained, it should be note that the present invention is not limited to the embodiments.

For example, in the present invention, swaging processing can be executed to the scheduled enlarged diameter portion 6 of the raw material 5 with the raw material 5 heated to a predetermined temperature or not heated. In other words, the forging method of the present invention can be a hot forging method or a cold forging method.

Furthermore, in cases where enlarged diameter portions 7 and 7 are formed at both end portions of the forged product, the enlarged diameter portions can be the same in shape, different in shape, the same in size or different in size.

Figure 18A:
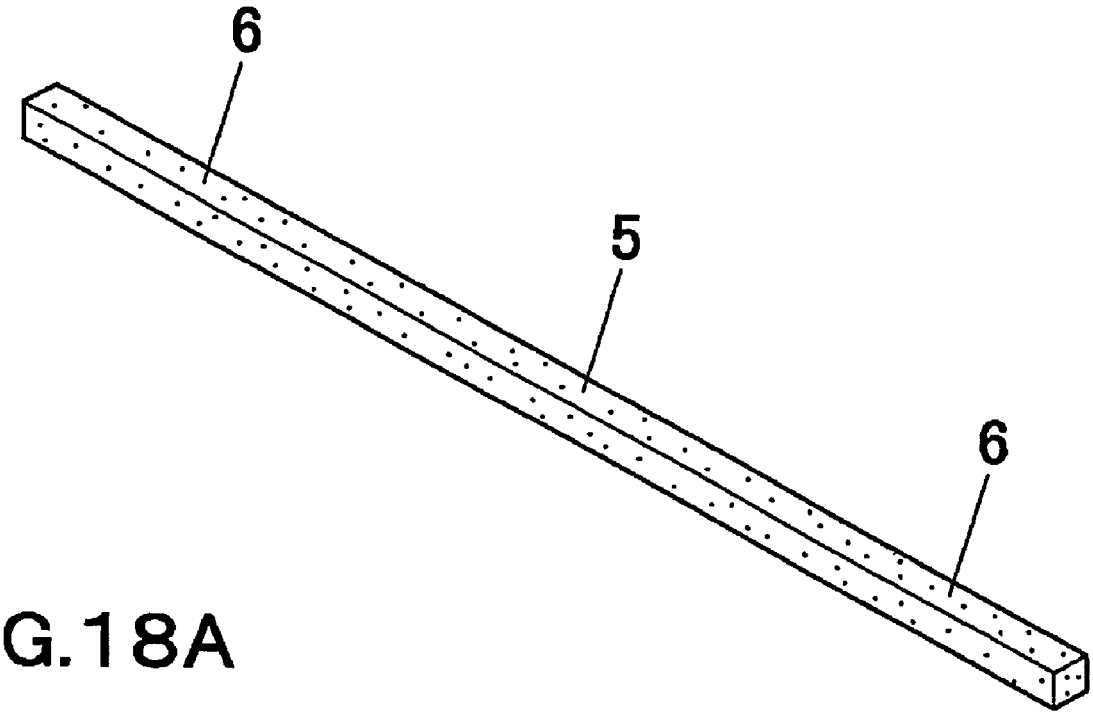
FIG. 18A is a schematic view showing the state before subjecting both end portions of the raw material to swaging processing by the forging apparatus according to the second embodiment.
Figure 18B:
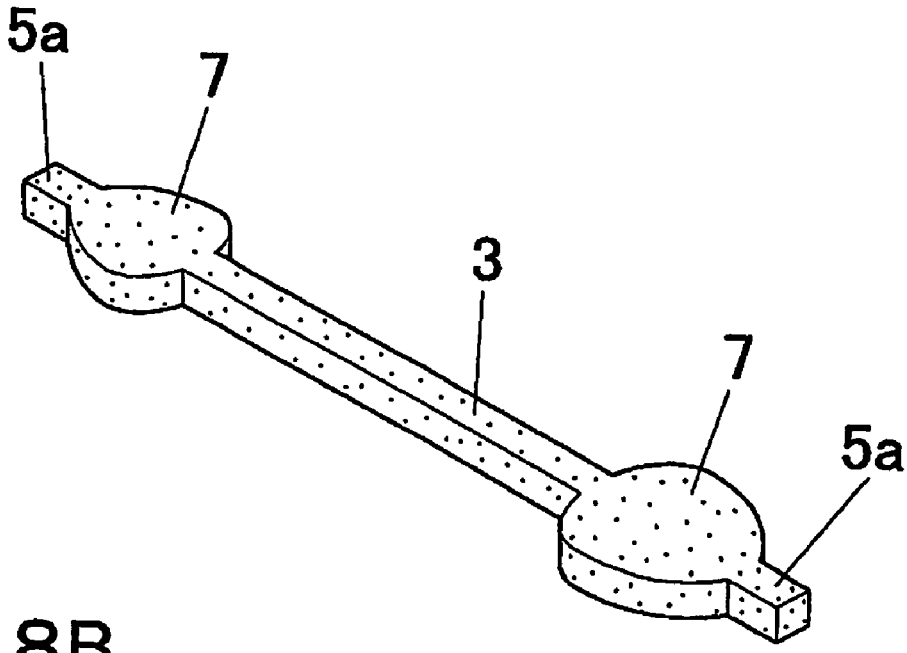
FIG. 18B is a schematic view showing the state after subjecting both end portions of the raw material to swaging processing by the forging apparatus according to the second embodiment.

In the present invention, in cases where a scheduled enlarged diameter portion 6 of a raw material 5 is an end portion (i.e., one end portion or the other end portion) of the raw material 5 and a forged product 3 is obtained by forming an enlarged diameter portion 7 at an end portion of the raw material 5 by subjecting the scheduled enlarged diameter portion 7 to swaging processing, the enlarged diameter portion 7 can be formed at the end portion of the forged product 3 and a non-swaged portion 5*a* can remain at a portion outside the enlarged diameter portion 7 formed at the end portion of the forged product 3 as shown in FIG. 18B, or the enlarged diameter portion 7 can be formed so that non-swaged portion does not remains at the end portion of the forged product 3.

According to the former forged product 3, in cases where a predetermined portion of the forged product 3 such as the enlarged diameter portion 7 is subjected to after processing, the non-swaged portion 5*a* can be chucked with a chuck (not shown), enabling easy after processing.

On the other hand, according to the later forged product 3, since no non-swaged portion remains at the end portion of the forged product 3, it is not necessary for the non-swaged portion to be subjected to processing, resulting in reduced manufacturing steps.

Figure 19:
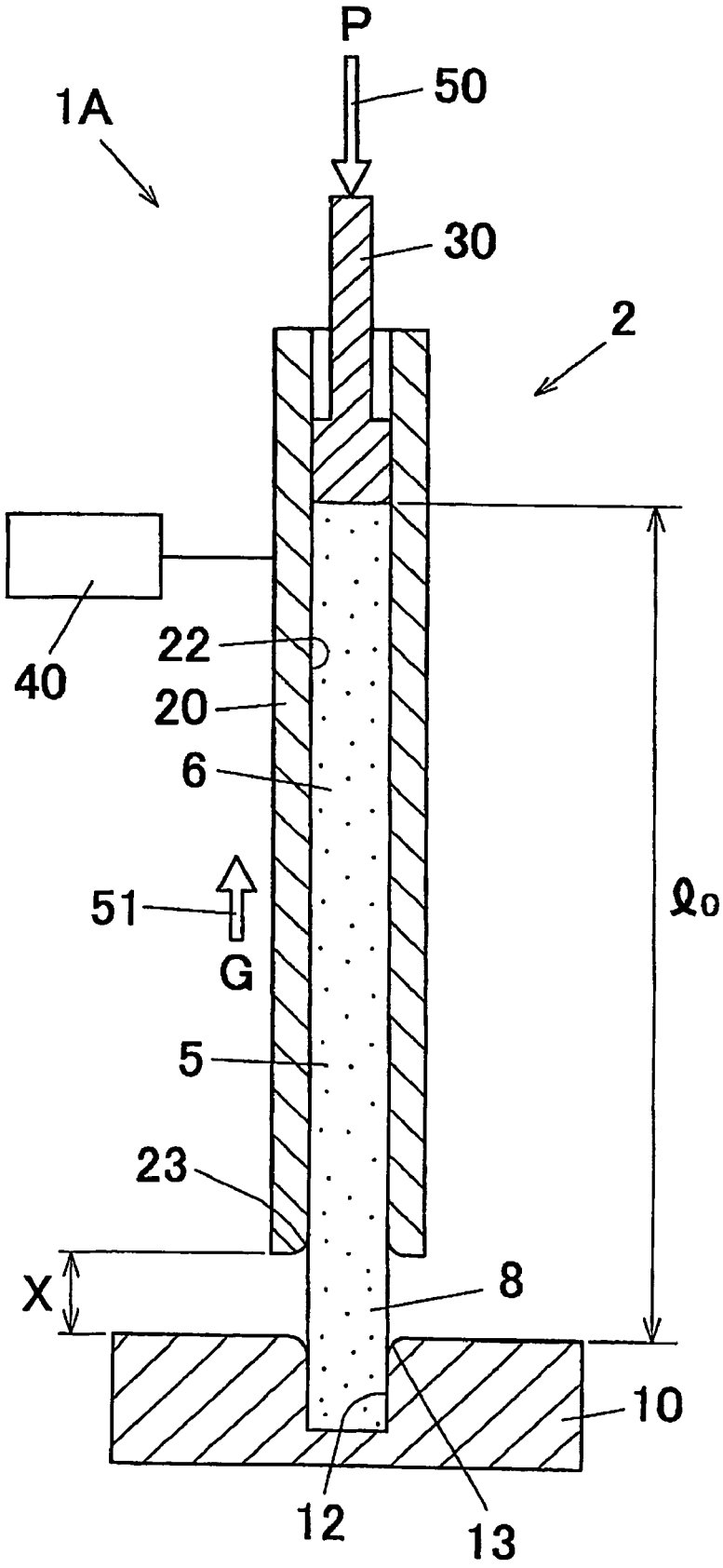
FIG. 19 is a cross-sectional view corresponding to FIG. 2 and showing the state before subjecting and end portion of a raw material to swaging processing by the forging apparatus according to the first embodiment.

Furthermore, in the present invention, as shown in FIG. 19, the opening edge portion of the raw material fixing and fitting aperture 12 can be beveled. The reference numeral "13" denotes a beveled portion formed at the opening edge portion. In this figure, beveling processing has been performed to the entire circumference of the opening edge portion, and therefore the cross-sectional shape of the opening edge portion is rounded.

In the present invention, the forged product 3 is not limited to a bar-shaped product.

Furthermore, the forged product 3 obtained by the forging method of the present invention is not limited to those shown in the aforementioned embodiments, and can be, for example, arm members, shaft members or connecting rods for use in automobiles, or dual-head pins for use in compressors.

In cases where a forged product 3 obtained by the forging method of the present invention is an automobile arm member (e.g., a suspension arm or an engine mount), the forging method of the present invention can be defined as follows.

That is, a forging method for manufacturing an automobile arm member characterized in that the method uses a swaging apparatus equipped with a fixing die for fixing a bar-shaped raw material, a guide having an insertion passage for inserting and holding the raw material in a buckling preventing sate, and a punch for pressing the raw material inserted in and held by the insertion passage of the guide in an axial direction of the raw material, wherein a scheduled enlarged diameter portion of the raw material fixed to the fixing die with the scheduled enlarged diameter portion protruded is inserted into the insertion passage of the guide, and thereafter, while pressing the raw material with the punch by moving the punch, in a state in which a part of a peripheral surface of an exposed portion of the raw material exposed between the guide and the fixing die is restrained or an entire peripheral surface of the exposed portion of the raw material is not restrained, the scheduled enlarged diameter portion of the raw material is subjected to swaging processing by moving the guide in a direction opposite to a moving direction of the punch so that a length of the exposed portion of the raw material becomes a buckling limit length or less at a cross-sectional area of the exposed portion of the raw material.

In this case, the scheduled enlarged diameter portion of the raw material will be, for example, a scheduled portion for forming a coupling portion to be connected to another member. The coupling portion has, for example, a bush mounting portion to which a bush is mounted. The bush mounting portion can be cylindrical for example.

In the case where the forged product 3 to be obtained by the forging method of the present invention is an automobile shaft member (e.g., a propeller shaft), the forging method of the present invention can be defined as follows.

That is, a method of manufacturing a shaft member for use in automobiles characterized in that a forging method uses a swaging apparatus equipped with a fixing die for fixing a bar-shaped raw material, a guide having an insertion passage for inserting and holding the raw material in a buckling preventing state, and a punch for pressing the raw material inserted in and held by the insertion passage of the guide in an axial direction of the raw material, wherein a scheduled enlarged diameter portion of the raw material fixed to the fixing die with the scheduled enlarged diameter portion protruded is inserted into the insertion passage of the guide, and thereafter, while pressing the raw material with the punch by moving the punch, in a state in which a part of a peripheral surface of an exposed portion of the raw material exposed between the guide and the fixing die is restrained or an entire peripheral surface of the exposed portion of the raw material is not restrained, the scheduled enlarged diameter portion of the raw material is subjected to swaging processing by moving the guide in a direction opposite to a moving direction of the punch so that a length of the exposed portion of the raw material becomes a buckling limit length or less at a cross-sectional area of the exposed portion of the raw material.

In this case, the scheduled enlarged diameter portion of the raw material can be a scheduled portion for forming a coupling portion to be connected to another member for example.

In the case where the forged product 3 to be obtained by the forging method of the present invention is an automobile connecting rod, the forging method of the present invention can be defined as follows.

That is, a method of manufacturing an automobile connecting rod characterized in that a forging method uses a swaging apparatus equipped with a fixing die for fixing a bar-shaped raw material, a guide having an insertion passage for inserting and holding the raw material in a buckling preventing state, and a punch for pressing the raw material inserted in and held by the insertion passage of the guide in an axial direction of the raw material, wherein a scheduled enlarged diameter portion of the raw material fixed to the fixing die with the scheduled enlarged diameter portion protruded is inserted into the insertion passage of the guide, and thereafter, while pressing the raw material with the punch by moving the punch, in a state in which a part of a peripheral surface of an exposed portion of the raw material exposed between the guide and the fixing die is restrained or an entire peripheral surface of the exposed portion of the raw material is not restrained, the scheduled enlarged diameter portion of the raw material is subjected to swaging processing by moving the guide in a direction opposite to a moving direction of the punch so that a length of the exposed portion of the raw material becomes a buckling limit length or less at a cross-sectional area of the exposed portion of the raw material.

In this case, the scheduled enlarged diameter portion of the raw material can be a scheduled portion for forming a coupling portion to be coupled to another member (e.g., crank, piston).

In the case where the forged product 3 to be obtained by the forging method of the present invention is a dual-head piston, the forging method of the present invention can be defined as follows.

That is, a method of manufacturing a dual-head piston for use in compressors characterized in that a forging method uses a swaging apparatus equipped with a fixing die for fixing a bar-shaped raw material, a guide having an insertion passage for inserting and holding the raw material in a buckling preventing state, and a punch for pressing the raw material inserted in and held by the insertion passage of the guide in an axial direction of the raw material, wherein a scheduled enlarged diameter portion of the raw material fixed to the fixing die with the scheduled enlarged diameter portion protruded is inserted into the insertion passage of the guide, and thereafter, while pressing the raw material with the punch by moving the punch, in a state in which a part of a peripheral surface of an exposed portion of the raw material exposed between the guide and the fixing die is restrained or an entire peripheral surface of the exposed portion of the raw material is not restrained, the scheduled enlarged diameter portion of the raw material is subjected to swaging processing by moving the guide in a direction opposite to a moving direction of the punch so that a length of the exposed portion of the raw material becomes a buckling limit length or less at a cross-sectional area of the exposed portion of the raw material.

In this case, the scheduled enlarged diameter portion of the raw material can be a scheduled portion for forming a head portion of the dual-head piston for example.

EXAMPLE

Example 1

A bar-shaped raw material 5 (material: aluminum alloy) round in cross-section and 18 mm in diameter was prepared. With the raw material 5 heated to 350° C., the one end portion (scheduled enlarged diameter portion 6) of the raw material 5 was subjected to swaging processing in accordance with the forging method of the first embodiment. By this swaging processing, a spindle-shaped enlarged diameter portion 7 was formed at the one end portion of the raw material 5. The average diameter of this enlarged diameter portion 7 was 30 mm, and the length L of the enlarged diameter portion 7 was 60 mm. The processing conditions employed in this forging method are shown in Table 1. The average moving speed G of the guide 20 satisfied the aforementioned relational expression (i).

In Table 1, "$V_0$" denotes an increased volume of the raw material 5 increased during the time lag $t_0$ within the range of the initial clearance X. "S" denotes a cross-sectional area of the raw material 5 at the time prior to the swaging processing. Accordingly, the time lag $t_0$ can be represented by $t_0=V_0/(SP)$.

Comparative Example 1

In the same manner as in Example 1, a bar-shaped raw material 5 (material: aluminum alloy) round in cross-section and 18 mm in diameter was prepared. Furthermore, in the same manner as in example 1, the one end portion (scheduled enlarged diameter portion 6) of the raw material 5 was subjected to swaging processing in accordance with the forging method of the first embodiment so that a spindle-shaped enlarged diameter portion 7 became 30 mm in average diameter of this enlarged diameter portion 7 and 60 mm in length L of the enlarged diameter portion 7. In this case, the average moving speed G of the guide 20 exceeded the upper limit of the aforementioned relational expression (i). The other conditions were the same as those in Example 1. The processing conditions applied to this forging method are shown in Table 1.

Example 2

A bar-shaped raw material 5 (material: aluminum alloy) quadrangular in cross-section and 10 mm square was prepared. With the raw material 5 heated to 350° C., while holding the side surfaces of the one end portion (scheduled enlarged diameter portion 6) of the raw material 5 in the thickness direction by a restraining die portion 15, the one end portion of the raw material 5 was subjected to swaging processing in accordance with the forging method of the second embodiment. By this swaging processing, a flat-shaped enlarged diameter portion 7 was formed at the one end portion of the raw material 5. The thickness of this enlarged diameter portion 7 was 10 mm, the average width of the enlarged diameter portion 7 was 18 mm, and the length L of the enlarged diameter portion 7 was 62 mm. The processing conditions employed in this forging method are shown in Table 1. The average moving speed G of the guide 20 satisfied the aforementioned relational expression (i).

Comparative Example 2

In the same manner as in Example 2, a bar-shaped raw material 5 (material: aluminum alloy) quadrangular in cross-section and 10 mm square was prepared. Furthermore, in the same manner as in Example 2, the one end portion (scheduled enlarged diameter portion 6) of the raw material 5 was subjected to swaging processing so that the average width of the enlarged diameter portion 7 became 18 mm and the length L of the enlarged diameter portion 7 became 62 mm. In this case, the average moving speed G of the guide 20 exceeded the upper limit of the aforementioned relational expression (i). The other conditions were the same as those in Example 2. The processing conditions applied to this forging method are shown in Table 1.

Example 3

A bar-shaped raw material 5 (material: aluminum alloy) quadrangular in cross-section and 10 mm square was prepared. With the raw material 5 heated to 350° C., while restraining the side surfaces of the one end portion (scheduled enlarged diameter portion 6) of the raw material 5 in the thickness direction with the restraining die portion 15, the one end portion of the raw material 5 was subjected to swaging processing in accordance with the forging method of the second embodiment. By this swaging processing, a flat-shaped enlarged diameter portion 7 was formed at the one end portion of the raw material 5. The restraining die portion 15 employed was provided with a closed forming dented portion 17. The processing conditions employed in this forging method are shown in Table 1. The average moving speed G of the guide 20 satisfied the aforementioned relational expression (i).

Thereafter, the enlarged diameter portion 7 of the raw material 5 was pressed by the second punch 32 to thereby fill the forming dented portion 17 with the material of the enlarged diameter portion 7 by plastically deforming the enlarged diameter portion 7 in the forming dented portion 17. By this forging method, a forged product with no flash, i.e., with a scheduled designed shape, was obtained. In this forged product, no processing defect such as wrinkles or lacks was observed.

Example 4

A bar-shaped raw material 5 (material: aluminum alloy) quadrangular in cross-section and 10 mm square was prepared. With the raw material 5 heated to 350° C., while restraining only the side surfaces of the one end portion (scheduled enlarged diameter portion 6) of the raw material 5 in the thickness direction by a restraining die portion 15, the one end portion of the raw material 5 was subjected to swaging processing in accordance with the forging method of the second embodiment. By this swaging processing, a flat-shaped enlarged diameter portion 7 was formed at the one end portion of the raw material 5. The forming dented portion 17 of the restraining die portion 15 employed was provided with a flash forming dented portion 18 continuing from the forming dented portion 17. The processing conditions employed in this forging method are shown in Table 1. The average moving speed G of the guide 20 satisfied the aforementioned relational expression (i).

Thereafter, the enlarged diameter portion 7 of the raw material 5 was pressed by the second punch 32 to thereby fill the forming dented portion 17 and the flash forming dented portion 18 with the material of the enlarged diameter portion 7 by plastically deforming the enlarged diameter portion 7 in the forming dented portion 17. By this forging method, a forged product with a flash similar to a scheduled designed shape was obtained.

In the forging methods of the aforementioned Examples 1-4 and Comparative Examples 1 and 2, it was observed whether there is buckling of the raw material 5. The results are shown in Table 1.

TABLE 1

| | Processing conditions | | | | | | | | | | |
|---|---|---|---|---|---|---|---|---|---|---|---|
| | P (mm/s) | $X_0$ (mm) | $X_1$ (mm) | X (mm) | $V_0$ ($mm^3$) | S ($mm^2$) | $T_0$ (s) | L (mm) | $I_0$ (mm) | G (mm/s) | Occurrence of buckling |
| Example 1 | 70 | 58 | 96 | 14 | 4253 | 245 | 0.24 | 60 | 167 | 36 | None |
| Example 2 | 50 | 38 | 67 | 15 | — | 100 | 0 | 62 | 112 | 47 | None |
| Example 3 | 50 | 38 | 82 | 15 | — | 100 | 0 | 62 | 136 | 32 | None |
| Example 4 | 50 | 38 | 67 | 15 | — | 100 | 0 | 62 | 112 | 47 | None |
| Comp. Example 1 | 70 | 58 | 96 | 14 | 4253 | 254 | 0.24 | 60 | 167 | 110 | Yes |
| Comp. Example 2 | 50 | 38 | 67 | 15 | — | 100 | 0 | 62 | 112 | 60 | Yes |

As shown in Table 1, when the average moving speed G of the guide satisfies the aforementioned relational expression (i) (i.e., Examples 1 to 4), no buckling was generated, and therefore high-quality forged products were obtained.

Example 5

A bar-shaped raw material 5 (material: aluminum alloy) round in cross-section and 20 mm in diameter was prepared. At the edge portion of the leading end surface of the guide 20 at the side of the insertion passage 22, beveling processing of diameter R=5 mm was executed. By using this guide 20, with the raw material 5 heated to 350° C., the one end portion (scheduled enlarged diameter portion 6) of the raw material 5 was subjected to swaging processing in accordance with the forging method of the first embodiment. In this forging method, the driving force required to move the guide 20 was 1.02 MPa (4 tons).

Example 6

In the same manner as in Example 5, a bar-shaped raw material 5 round in cross-section and 20 mm in diameter was prepared. On the other hand, at the edge portion of the leading end surface of the guide 20 at the side of the insertion passage 22, no beveling processing was executed. By using this guide 20, under the same processing conditions as in Example 5, the one end portion (scheduled enlarged diameter portion 6) of the raw material 5 was subjected to swaging processing. In this forging method, the driving force required to move the guide 20 was 1.274 MPa (5 tons).

As will be understood from the comparison between the driving force required to move the guide 20 in the forging method in Example 5 and that in the forging method in Example 6, in the forging method of Example 5, it was possible to move the guide 20 at driving force smaller than that of the forging method of Example 6.

Example 7

In order to manufacture a straight-bar-shaped arm member for use in automobiles, a bar-shaped raw material 5 (material: aluminum alloy) quadrangular in cross-section and 10 mm square was prepared. With the raw material 5 heated to 350° C., while restraining only side surfaces of the one end portion (scheduled enlarged diameter portion 6) of the raw material 5 in the thickness direction by a restraining die portion 15 and further restraining only side surfaces of the other end portion (scheduled enlarged diameter portion 6) of the raw material 5 in the thickness direction by a restraining die portion 15, the one end portion and the other end portion of the raw material 5 were simultaneously subjected to swaging processing in accordance with the forging method of the second embodiment. By this swaging processing, a flat-shaped enlarged diameter portion 7 was formed at the one end portion of the raw material 5 and the other end portion thereof, respectively. The forming dented portion 17 of the restraining die portion 15 employed was provided with a closed forming dented portion 17. The average moving speed G of the guide 20 satisfied the aforementioned relational expression (i).

Thereafter, the central portion of each enlarged diameter portion 7 of the raw material 5 was pressed by the second punch 32 to thereby fill the forming dented portion 17 with the material of the enlarged diameter portion 7 by plastically deforming each enlarged diameter portion 7 within the corresponding forming dented portion 17. By pressing the enlarged diameter portion 7 with the second punch 32, at the central portion of the enlarged diameter portion 7, a bush mounting aperture for mounting a bush was formed, and the enlarged diameter portion 7 was formed into a cylindrical shape. This cylindrical enlarged diameter portion will be used as a coupling portion having a bush mounting portion for mounting a bush. Thus, by this forging method, a straight bar-shaped arm member of a scheduled design shape in which cylindrical coupling portions each having a bush mounting portion for mounting a bush were integrally formed at both end portions was obtained. In this arm member, processing deft such as wrinkles or lacks were not founded.

Example 8

In order to manufacture a shaft member for use in automobiles, a bar-shaped raw material 5 (material: aluminum alloy) round in cross-section and 20 mm in diameter was prepared. With the raw material 5 heated to 350° C., while restraining only side surfaces of the one end portion (scheduled enlarged diameter portion 6) of the raw material 5 in the thickness direction by a restraining die portion 15 and further restraining only side surfaces of the other end portion (scheduled enlarged diameter portion 6) of the raw material 5 in the thickness direction by a restraining die portion 15, the one end portion of the raw material 5 and the other end portion thereof were simultaneously subjected to swaging processing in accordance with the forging method of the second embodiment. By this swaging processing, a flat-shaped enlarged diameter portion 7 was formed at the one end portion of the raw material 5 and the other end portion thereof, respectively. The forming dented portion 17 of the restraining die portion 15 employed was provided with a closed forming dented portion 17. The average moving speed G of the guide 20 satisfied the aforementioned relational expression (i).

Thereafter, a portion of each enlarged diameter portion 7 of the raw material 5 was pressed by the second punch 32 to thereby fill the forming dented portion 17 with the material of the enlarged diameter portion 7 by plastically deforming each enlarged diameter portion 7 within the corresponding forming dented portion 17. By this forging method, a shaft member of a scheduled design shape in which coupling portions to be coupled to another member were integrally formed at both end portions was obtained. In this shaft member, no processing defects such as a wrinkle or a lack was found.

Example 9

In order to manufacture a connecting rod for use in automobiles, a bar-shaped raw material 5 (material: aluminum alloy) quadrangular in cross-section and 10 mm square was prepared. With the raw material 5 heated to 350° C., while restraining only side surfaces of the one end portion (scheduled enlarged diameter portion 6) of the raw material 5 in the thickness direction by a retraining die portion 15 and further restraining only side surfaces of the other end portion (scheduled enlarged diameter portion 6) of the raw material 5 in the thickness direction by a restraining die portion 15, the one end portion of the raw material 5 and the other end portion thereof were simultaneously subjected to swaging processing in accordance with the forging method of the second embodiment. By this swaging processing, a flat-shaped enlarged diameter portion 7 was formed at the one end portion of the raw material 5 and the other end portion thereof, respectively. The forming dented portion 17 of the restraining die portion 15 employed was provided with a closed forming dented portion 17. The average moving speed G of the guide 20 satisfied the aforementioned relational expression (i).

Thereafter, a portion of each enlarged diameter portion 7 of the raw material 5 was pressed by the second punch 32 to thereby fill the forming dented portion 17 with the material of the enlarged diameter portion 7 by plastically deforming each enlarged diameter portion 7 in the corresponding forming dented portion 17. By pressing the enlarged diameter portion 7 with the second punch 32, at the central portion of the enlarged diameter portion 7, a coupling aperture was formed, and the enlarged diameter portion 7 was formed into a cylindrical shape. This cylindrical enlarged diameter portion will be used as a coupling portion to be connected to another member (crank or piston). That is, by this forging method, a connecting rod of a scheduled design shape in which a coupling portion to be connected to another member is integrally formed at both end portions. In this connecting rod, processing defects such as wrinkles or lacks were not founded.

Example 10

In order to manufacture a dual-head piston for use in compressors, a bar-shaped raw material 5 (material: aluminum alloy) round in cross-section and 20 mm in diameter was prepared. With the raw material 5 heated to 350° C., while restraining only side surfaces of the one end portion (scheduled enlarged diameter portion 6) of the raw material 5 in the thickness direction by a restraining die portion 15 and further restraining one side surfaces of the other end portion (scheduled enlarged diameter portion 6) of the raw material 5 in the thickness direction by a restraining die portion 15, the one end portion of the raw material 5 and the other end portion thereof were simultaneously subjected to swaging processing in accordance with the forging method of the second embodiment. By this swaging processing, a flat-shaped enlarged diameter portion 7 was formed at the one end portion of the raw material 5 and the other end portion thereof, respectively. The forming dented portion 17 of the restraining die portion 15 employed was provided with a closed forming dented portion 17. The average moving speed G of the guide 20 satisfied the aforementioned relational expression (i). By this forging method, a dual-head piston of a scheduled design shape in which a head portion (i.e., piston main body) was integrally formed at both end portions was obtained. In this dual-head piston, no processing defect such as a wrinkle or a lack was found.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

INDUSTRIAL APPLICABILITY

The forging method and forging apparatus according to the present invention can be preferably used for manufacturing a member having one or a plurality of larger diameter portion such as an arm member, a shaft member, a connecting rod for use in automobiles, or a dual-head piston for use in compressors.

The invention claimed is:

1. A forging method for upsetting a diameter expansion scheduled portion of a bar-shaped raw material using an upsetting apparatus equipped with a fixing die for fixing the bar-shaped raw material, a guide having an insertion passage for inserting and holding the raw material in a buckling preventing state, and a punch for axially pressing the raw material inserted in and held by the insertion passage of the guide, the forging method comprising:

inserting the diameter expansion scheduled portion of the raw material fixed to the fixing die with the diameter expansion scheduled portion protruded from the fixing die into the insertion passage of the guide; and moving the guide in a direction opposite to a moving direction of the punch while axially pressing the raw material with the punch by moving the punch in a state in which a part of a peripheral surface of an exposed portion of the raw material exposed between the guide and the fixing die is restrained or an entire peripheral surface of the exposed portion of the raw material is not restrained, to thereby execute upsetting of the diameter expansion scheduled portion of the raw material, wherein the upsetting is executed so that, in the case of $t_0<T$, G satisfies a relational expression of:

$$(L-X)/[(l_0-L)/P-t_0]\leqq G\leqq P(X_1-X)/(l_0-X_1-Pt_0),$$

where P is an average moving speed of the punch from initiation of a movement thereof, G is an average moving speed of the guide from initiation of the movement thereof, $X_0$ is a buckling limit length at the cross-sectional area of the raw material before the upsetting, $X_1$ is a buckling limit length at the cross-sectional area of an enlarged diameter portion of the raw material after the upsetting, X is an initial clearance between the guide and the fixing die ($O\leqq X\leqq X_0$), $t_0$ is a time lag from the initiation of the movement of the punch to the initiation of the movement of the guide ($\mathbf{0}\leqq t_0$), L is a length of the enlarged diameter portion of the raw material after the upsetting, $l_0$ is a length of the raw material in the state prior to the upsetting required for the enlarged diameter portion, and T is upsetting time from the initiation of the movement of the punch.

2. The forging method as recited in claim 1, wherein the diameter expansion scheduled portion of the raw material is an end portion of the raw material.

3. The forging method as recited in claim 1, wherein the diameter expansion scheduled portion of the raw material is an axial central portion of the raw material.

4. The forging method as recited in claim 1, wherein the diameter expansion scheduled portion of the raw material is one end portion of the raw material and the other end portion thereon, wherein each of the one end portion and the other end portion of the raw material fixed to the fixing die with the one end portion and the other end portion protruded from the fixing die is inserted into the insertion passage of the corresponding guide, and wherein the one end portion and the other end portion are simultaneously subjected to upsetting.

5. The forging method as recited in claim 1, wherein an edge portion of a leading end surface of the guide at a side of the insertion passage and/or an opening edge portion of a raw material fixing and fitting aperture formed in the fixing die are beveled.

6. The forging method as recited in claim 1, wherein the diameter expansion scheduled portion of the raw material is subjected to upsetting with a part of a peripheral surface of the raw material restrained by a restraining die portion having a forming dented portion, and thereafter the enlarged diameter portion of the raw material is pressed with a second punch provided at the restraining die portion to thereby fill the forming dented portion with the material of the enlarged diameter portion by plastically deforming the enlarged diameter portion within the forming dented portion of the restraining die portion.

7. The forging method as recited in claim 6, wherein the fixing die is provided with a flash forming dented portion continuing from the forming dented portion of the restraining die portion, and wherein the material of the enlarged diameter portion is filled into the forming dented portion and the flash forming dented portion by plastically deforming the enlarged diameter portion within the forming dented portion of the restraining die portion.

8. The forging method as recited in claim 6, wherein the forming dented portion is a closed dented portion.

9. A forging apparatus comprising:

an upsetting apparatus comprising a fixing die for fixing a bar-shaped raw material, a guide having an insertion passage for inserting and holding the raw material in a buckling preventing state, a punch for axially pressing the raw material inserted in and held by the insertion passage of the guide, and a guide driving device for moving the guide in a direction opposite to a moving direction of the punch so that a length of the exposed portion of the raw material exposed between the guide and the fixing die becomes equal to or less than a buckling limit length at a cross-sectional area of the exposed portion of the raw material, wherein the guide driving device is configured to move the guide so that, if $t_0\leqq T$, G satisfies a relational expression of:

$$(L-X)/[(l_0-L)/P-t_0]\leqq G\leqq P(X_1-X)/(l_0-X_1-Pt_0),$$

where P is an average moving speed of the punch from initiation of a movement thereof, G is an average moving speed of the guide from initiation of the movement thereof, $X_0$ is a buckling limit length at the cross-sectional area of the raw material before the upsetting, $X_1$ is a buckling limit length at the cross-sectional area of an enlarged diameter portion of the raw material after the upsetting, X is an initial clearance between the guide and the fixing die ($\mathbf{0}\leqq X\leqq X_0$), $t_0$ is a time lag from the initiation of the movement of the guide ($\mathbf{0}\leqq t_0$), L is a length of the enlarged diameter portion of the raw material after the upsetting, $l_0$ is a length of the raw material in the state prior to the upsetting required for the enlarged diameter portion, and T is an upsetting time from the initiation of the movement of the punch.

10. The forging apparatus as recited in claim 9, wherein the upsetting apparatus performs upsetting in a state in which a part of a peripheral surface of the exposed portion of the raw material is restrained or an entire peripheral surface of the exposed portion of the raw material is not restrained.

11. The forging apparatus as recited in claim 9, wherein the upsetting apparatus further includes a restraining die portion for restraining a part of the peripheral surface of the exposed portion of the raw material.

12. The forging apparatus as recited in claim 11, wherein the restraining die portion is provided with a second punch for pressing the enlarged diameter portion of the raw material formed by the upsetting apparatus and a forming dented portion into which the material of the enlarged diameter portion is filled by the pressing of the enlarged diameter portion by the second punch.

13. The forging apparatus as recited in claim 12, wherein the fixing die is provided with a flash forming dented portion continuing from the forming dented portion of the restraining die portion.

14. The forging apparatus as recited in claim 12, wherein the forming dented portion is a closed dented portion.

* * * * *

UNITED STATES PATENT AND TRADEMARK OFFICE

CERTIFICATE OF CORRECTION

PATENT NO. : 7,461,533 B2
APPLICATION NO. : 10/566467
DATED : December 9, 2008
INVENTOR(S) : Atsushi Otaki et al.

It is certified that error appears in the above-identified patent and that said Letters Patent is hereby corrected as shown below:

On the Title Page, Item (54), Title of the Invention, insert --,-- after "METHOD".

Column 30, line 4, change "thereon" to --thereof--.

Signed and Sealed this

Eleventh Day of August, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,461,533 B2
APPLICATION NO. : 10/566467
DATED : December 9, 2008
INVENTOR(S) : Atsushi Otaki et al.

It is certified that error appears in the above-identified patent and that said Letters Patent is hereby corrected as shown below:

On the Title Page, Item (54) and Column 1, line 1, Title of the Invention, insert --,-- after "METHOD".

Column 30, line 4, change "thereon" to --thereof--.

This certificate supersedes the Certificate of Correction issued August 11, 2009.

Signed and Sealed this

First Day of September, 2009

David J. Kappos

David J. Kappos
*Director of the United States Patent and Trademark Office*